US008763171B2

(12) United States Patent
Dewyea et al.

(10) Patent No.: US 8,763,171 B2
(45) Date of Patent: Jul. 1, 2014

(54) METHODS, APPARATUS AND KITS FOR SPLICING TUBES

(75) Inventors: Nathan Dewyea, Salt Lake City, UT (US); Lamont Drechsel, Salt Lake City, UT (US); Kelly Ragsdale, Salt Lake City, UT (US)

(73) Assignee: Cover-Pools Incorporated, Salt Lake City, UT (US)

( * ) Notice: Subject to any disclaimer, the term of this patent is extended or adjusted under 35 U.S.C. 154(b) by 1144 days.

(21) Appl. No.: 12/612,151

(22) Filed: Nov. 4, 2009

(65) Prior Publication Data

US 2010/0122407 A1 May 20, 2010

Related U.S. Application Data

(60) Provisional application No. 61/115,811, filed on Nov. 18, 2008.

(51) Int. Cl.
*E04H 4/00* (2006.01)

(52) U.S. Cl.
USPC ..... 4/502

(58) Field of Classification Search
CPC ..... E04H 4/101; E04H 4/10
USPC ..... 4/498, 500, 502, 503
See application file for complete search history.

(56) References Cited

U.S. PATENT DOCUMENTS

| | | | | |
|---|---|---|---|---|
| 4,811,433 | A * | 3/1989 | MacDonald et al. | 4/502 |
| 5,105,481 | A | 4/1992 | Lamb et al. | |
| 5,524,302 | A | 6/1996 | Ragsdale et al. | |
| 5,913,613 | A | 6/1999 | Ragsdale et al. | |
| 6,381,767 | B1 * | 5/2002 | Brashears | 4/498 |
| 6,622,318 | B2 | 9/2003 | Mathis | |
| 6,760,930 | B2 * | 7/2004 | Bertoni | 4/502 |

* cited by examiner

*Primary Examiner* — Huyen Le
(74) *Attorney, Agent, or Firm* — Dean W. Russell; Kilpatrick Townsend & Stockton LLP

(57) ABSTRACT

A splicing apparatus for interconnecting tubes may include: a first longitudinally elongate structure including a first radially outer surface and a first radially inner surface; a second longitudinally elongate structure including a second radially outer surface and a second radially inner surface, the first and second structures being configured to be arranged with the first and second inner surfaces facing each together and the first and second outer surfaces defining an equivalent diameter; and at least one movable element configured to engage the first and second inner surfaces, whereby movement of the at least one movable element changes a relative position of the first and second structures thereby changing the equivalent diameter defined by the first and second outer surfaces. A kit for a pool cover assembly may include first and second tubes and a splicing apparatus configured to interconnect the tubes.

14 Claims, 23 Drawing Sheets

METHODS, APPARATUS AND KITS FOR SPLICING TUBES

REFERENCE TO PROVISIONAL APPLICATION

This application is based on, claims priority to, and hereby refers to U.S. Provisional Patent Application Ser. No. 61/115,811, filed Nov. 18, 2008, having the same title as appears above, the entire contents of which are incorporated herein by this reference.

BACKGROUND

This application relates to methods, apparatus and kits for splicing tubes together. In particular, this application relates to such methods, apparatus and kits that are configured to splice together tubes of a pool cover assembly, such as a leading edge support tube and/or a collection tube.

Retractable pool cover systems are known that employ such tubes. For example, U.S. Pat. No. 5,524,302, which is hereby incorporated by reference herein in its entirety, discloses a method and apparatus for extending and retracting swimming pool covers. In particular, this patent discusses the use of a cylindrical collection tube or drum on which a pool cover is adapted to be collected by rotating the collection tube with a drive mechanism.

U.S. Pat. No. 6,622,318, which is hereby incorporated by reference herein in its entirety, also discloses a pool cover system that employs a collection tube or drum. This patent also depicts the use of a support tube at a leading edge of the pool cover.

SUMMARY

One embodiment may take the form of a splicing apparatus for interconnecting tubes. The splicing apparatus may include: a first longitudinally elongate structure including a first radially outer surface and a first radially inner surface; a second longitudinally elongate structure including a second radially outer surface and a second radially inner surface, the first and second structures being configured to be arranged with the first and second inner surfaces facing each together and the first and second outer surfaces defining an equivalent diameter; and at least one movable element configured to engage the first and second inner surfaces, whereby movement of the at least one movable element changes a relative position of the first and second structures thereby changing the equivalent diameter defined by the first and second outer surfaces.

Another embodiment may take the form of a kit for a pool cover assembly. The kit may include: a first tube including a first hollow end; a second tub including a second hollow end; and a splicing apparatus configured to be mounted into the opening of the first hollow end and the opening of the second hollow end and radially expanded while inserted therein to interconnect the first tube and the second tube.

Another embodiment may take the form of a method of interconnecting a first tube and a second tube using a splicing apparatus. The method may include: inserting the splicing apparatus into a first end of the first tube; inserting the splicing apparatus into a second end of the second tube; and increasing an equivalent diameter of the splicing apparatus while inserted into the first and second ends to engage an inner surface of each tube thereby interconnecting the first and second tubes with the splicing apparatus.

As will be appreciated from this disclosure, various features and advantages may be realized. For example, various embodiments disclosed herein may facilitate the use of a plurality of shorter lengths of tubes instead of a single tube of an ultimately desired length. Whereas, a forty foot long tube may be difficult and/or costly to manufacture and/or transport to an ultimate point of use, four ten foot long tubes may ease manufacturing and/or transport, thereby reducing costs and/or enabling designs that may not be as feasible or practical for tubes of longer lengths. It should be understood that these lengths are only examples, and that lengths of tubes may vary as needed for a given application.

In general, the splicing apparatus and the methods for using a splicing apparatus disclosed herein may provide a way to interconnect two tubes by engaging respective inner surfaces of the two tubes. The apparatus and methods may involve a friction and/or pressure fit engagement with the inner surfaces. The engagement may be accomplished by increasing or expanding an equivalent diameter of the splicing apparatus while the apparatus is disposed within respective ends of the tubes.

DETAILED DESCRIPTION

Various details described in this application relate to apparatus, kits and methods for interconnecting two tubes for a retractable pool cover assembly or system. However, it should be understood that the apparatus, kits and methods disclosed herein may be applicable to other endeavors where interconnecting two tubes may be required or desirable. Thus, while certain embodiments are described in the context of leading edge support tubes and/or collection tubes as may be employed in pool cover assemblies or systems, such description is not intended to limit this disclosure to such applications.

Further, while certain methods of interconnecting tubes using a splicing apparatus are described in detail, it should be understood that other methods and structures will be apparent from this disclosure and the structures described herein.

It should also be understood that the tubes that may be interconnected by the apparatus, kits and/or methods described herein are not limited to cylindrical or hollow tubes. For example, tubes that include at least one hollow end may be interconnected as described herein. Further, neither the inner nor the outer shape of the tube is limited to cylindrical or arcuate. For example, the outer shape of the tubes may be of any design as may be appropriate or desired for a given application. Similarly, the inner shape of the tubes, at least at the respective ends where the interconnection is to be made, may be varied in as much as the shape of an outer surface of the splicing apparatus may be varied to cooperate therewith as described herein. As such, this disclosure describes cylindrical tubes and arcuate outer surfaces of the splicing apparatus for ease of description and understanding, not as a matter of limitation.

The term "equivalent diameter" is also used herein for ease of description. This term should be understood as meaning the diametrical cross-sectional width of the splicing apparatus regardless of shape. For example, a "star-shaped" splicing apparatus would present an equivalent diameter as defined by the diameter of a circle circumscribing the points of the star. In any case, a change in the equivalent diameter as described herein should be understood as an increase or decrease in cross-sectional span.

Figure 1:
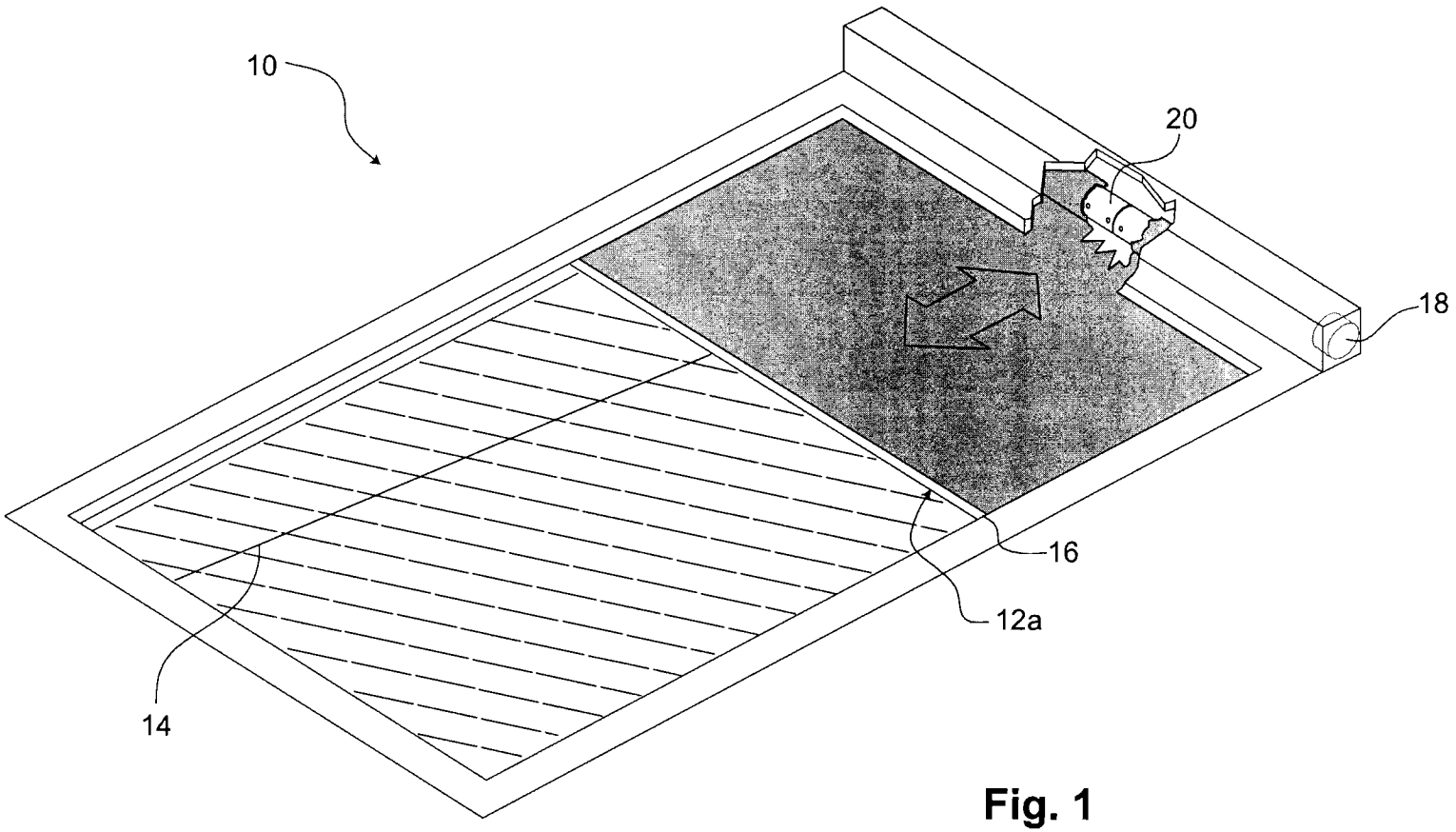
FIG. 1 is a perspective illustration of a swimming pool including a retractable pool cover system in which embodiments of this disclosure may be employed.

FIG. 1 is a perspective illustration of a swimming pool 10 including a retractable pool cover system in which embodiments of this disclosure may be employed. A pool cover 12 of the system may include a leading edge 12*a* to which a cable 14 may be attached. The leading edge 12*a* of the pool cover 12 may be connected to or otherwise include a leading edge support tube 16. For example, the leading edge 12*a* may be connected to the leading edge support tube 16, which may then be attached to the cable 14. Alternatively, the leading edge support tube 16 may be disposed in a pocket formed in the leading edge 12*a*, with the cable 14 attached to the leading edge 12*a*. In either case, the cable 14 may be driven by a drive mechanism 18 to pull the pool cover 12 so that the pool cover 12 is extended over the swimming pool 10, and retract the pool cover 12 to uncover the swimming pool 10. At an opposite end to the leading edge 12*a*, the pool cover 12 may be attached to a collection tube 20. The collection tube 20 may be driven by the drive mechanism 18 (or another drive mechanism) to rotate so as to roll the pool cover 12 onto the collection tube 20, retracting the pool cover 12 from over the swimming pool 10.

It should be understood that the swimming pool and retractable pool cover system shown in FIG. 1 is only an example for the sake of understanding, and not limitation. As discussed above, the apparatus, kits and methods disclosed herein are not limited to the particular context of tubes of a pool cover assembly. Thus, not only is this disclosure not limited to a particular implementation of a pool cover assembly or system, this disclosure is not limited to application to tubes of pool cover assemblies.

Figure 2:
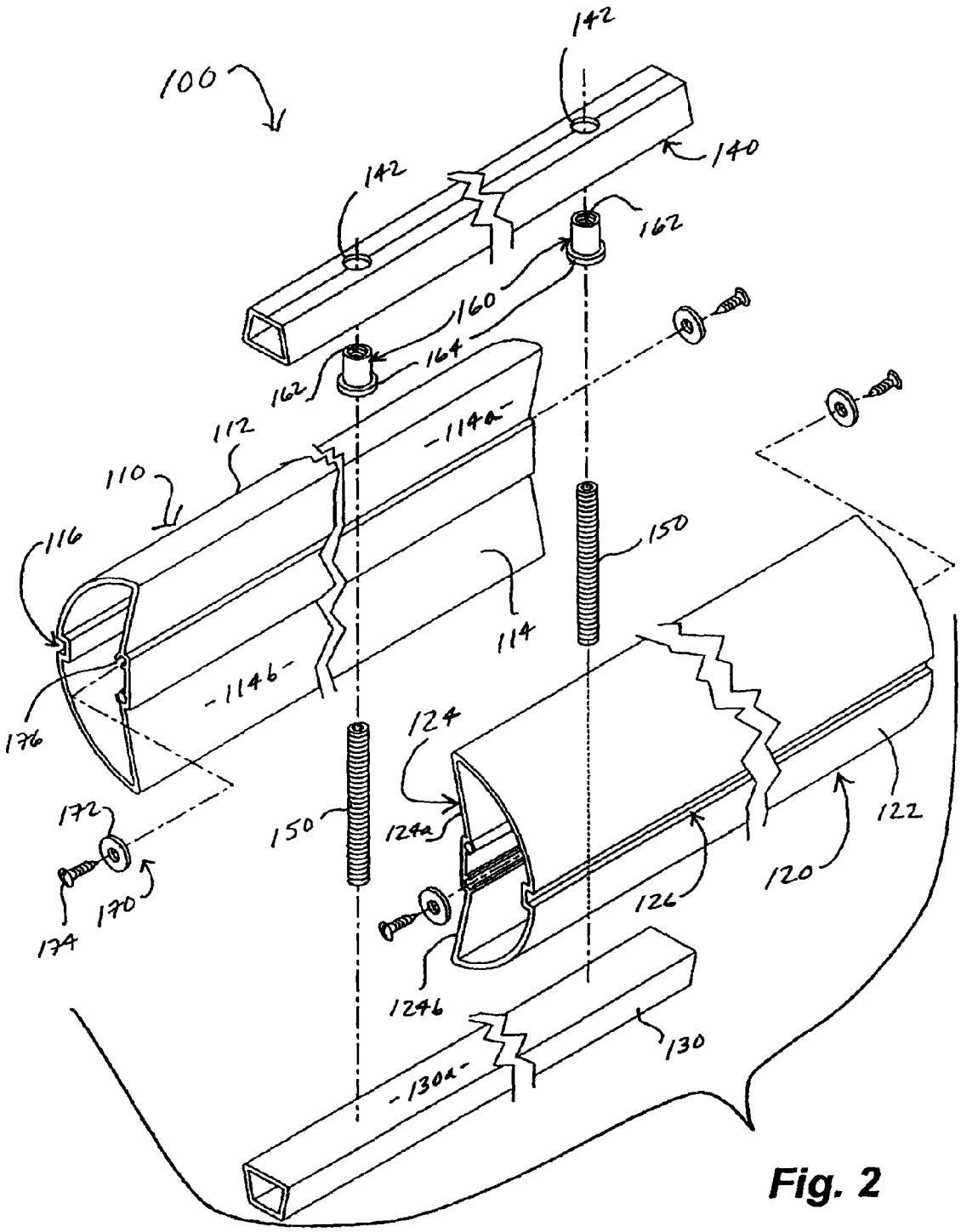
FIG. 2 is an exploded illustration of one embodiment of a splicing apparatus for interconnecting tubes.

FIG. 2 is an exploded illustration of one embodiment of a splicing apparatus 100 for interconnecting tubes. As shown, the splicing apparatus 100 may include a first longitudinally elongate structure or member 110. The first elongate structure 110 may include or define a first radially outer surface 112 and a first radially inner surface 114. It should be understood that the phrases "radially outer" and "radially inner" are used with respect to the splicing apparatus as assembled, as described herein.

The first radially inner surface 114 may include a first sloped portion 114*a* and a second sloped portion 114*b*. It should be understood that the term "sloped" is used here as being relative to a hypothetical planar surface for the first radially inner surface 114. Thus, the first and second sloped portions 114*a*, 114*b* may be described as sloping radially outward in a direction toward each other.

The first elongate structure 110 may also include a first rotational engagement structure 116 defined on or in the first radially outer surface 112. As described herein, the first rotational engagement structure 116 may be configured to engage a corresponding mating structure in or on an inner surface of a tube, thus providing alignment and/or rotational interrelation between the splicing apparatus 100 and the tube in which the splicing apparatus 100 is inserted.

The splicing apparatus 100 may include a second longitudinally elongate structure or member 120. As with the first elongate structure 110, the second elongate structure may include or define a second radially outer surface 122 and a second radially inner surface 124. The second radially inner surface 124 may similarly include a first sloped portion 124*a* and a second sloped portion 124*b*. Further, the second elongate structure 120 may also include a second rotational engagement structure 126 defined on or in the second radially outer surface 122.

The splicing apparatus 100 may include at least one first movable element 130. The first movable element 130 may be in the form of a trapezoidal wedge, which may be hollow as shown, solid or otherwise, as appropriate or desired. It should be understood that the wedge may be triangular or any other suitable shape as well. In the case of the hollow, trapezoidal wedge first movable element 130 shown, benefits of weight reduction and strength may be obtained. Further, a substantially flat top as shown may provide a suitable bearing surface 130*a* as described herein.

The splicing apparatus 100 may include at least one second movable element 140. The second movable element 140 may also be in the form of a trapezoidal wedge, which may be hollow as shown, solid or otherwise, as appropriate or desired. It should be understood that the wedge may be triangular or any other suitable shape as well. In the case of the hollow, trapezoidal wedge second movable element 140 shown, a substantially flat top and bottom as shown may facilitate the formation of holes 142 therethrough.

The splicing apparatus 100 may include at least one third movable element 150. The third movable element 150 may be in the form of a threaded rod. The third movable element 150 may be configured as such to engage a threaded insert, such as a threaded rivet nut 160. As shown, the threaded nut 160 may include a threaded bore 162 for engaging the threads of the third movable element 150 and a radially extending collar 164 for engaging the second movable element when the threaded nut 160 is disposed in one of the holes 142. The third movable element 150 may also be configured to engage the first movable element 130, for example, by contacting the bearing surface 130*a*.

The first elongate structure 110 and the second elongate structure 120 may be formed as extrusions of aluminum or other suitable material. The first movable element 130 and the second movable element 140 may be made of acetal or other suitable material that provides a high bending moment of inertia.

It should be understood from FIG. 2 that the first and/or second movable elements 130, 140 may be formed by a single respective elongate element or by a plurality of respective elements, as appropriate or desired. Further, although a plurality of third movable elements 150 is depicted, it should be understood that employing a single third movable element is not excluded.

The splicing apparatus 100 may further include means 170 for longitudinally securing the first elongate structure 110, the second elongate structure 120, the first movable element 130 and the second movable element 140 together. The means 170 may comprise a washer 172, an associated screw 174 and a corresponding bore 176 formed on at least one of the first elongate structure 110, the second elongate structure 120, the first movable element 130 and the second movable element 140. For example, one or more of the bores 176 may be formed on the first elongate structure 110 and/or the second elongate structure 120 at each end thereof. As illustrated, a respective one of the screws 174 may pass through a respective one of the washers 172 and engage a respective one of the bores 176.

Figure 3:
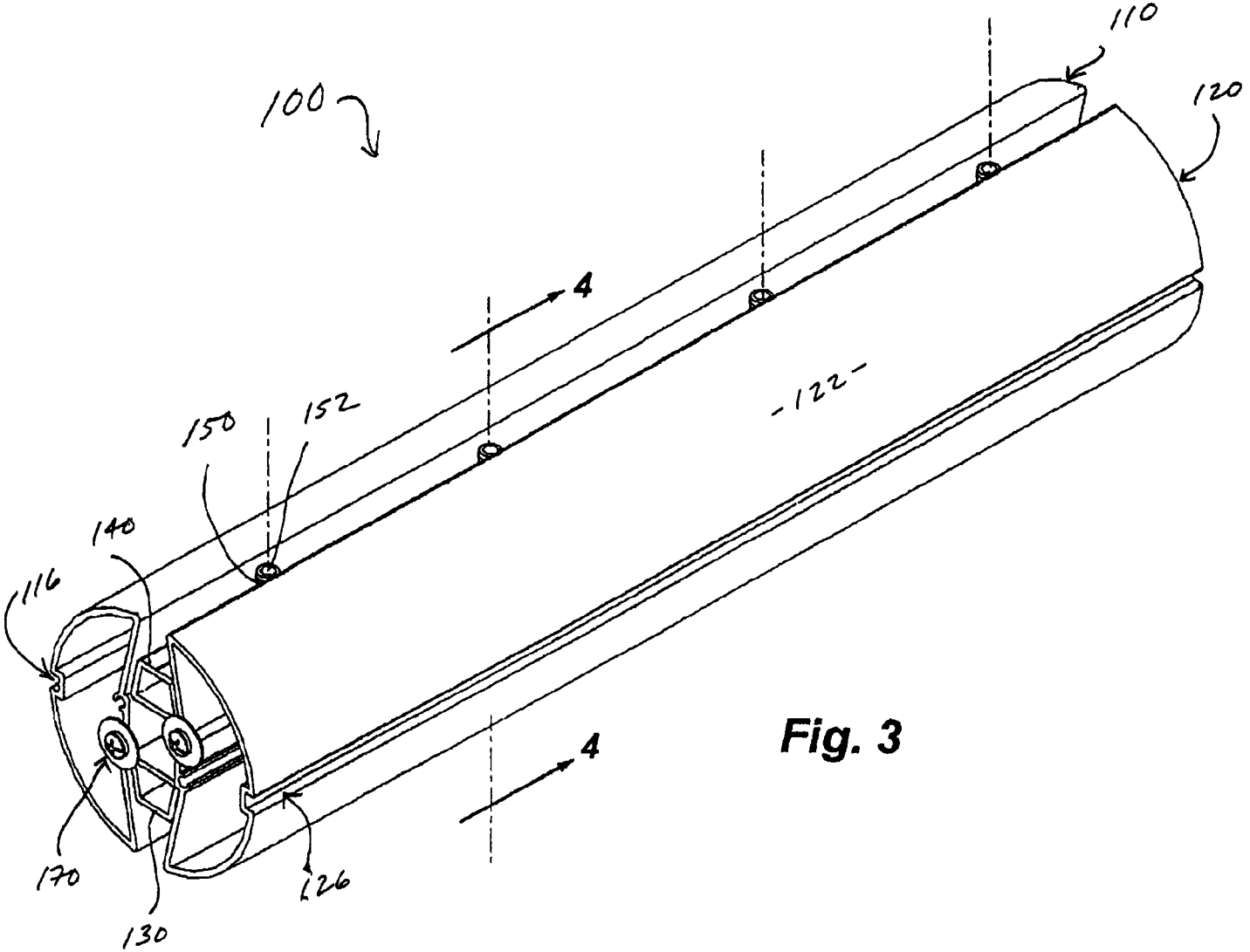
FIG. 3 is a perspective view of the splicing apparatus shown in FIG. 2 as assembled.
Figure 4:
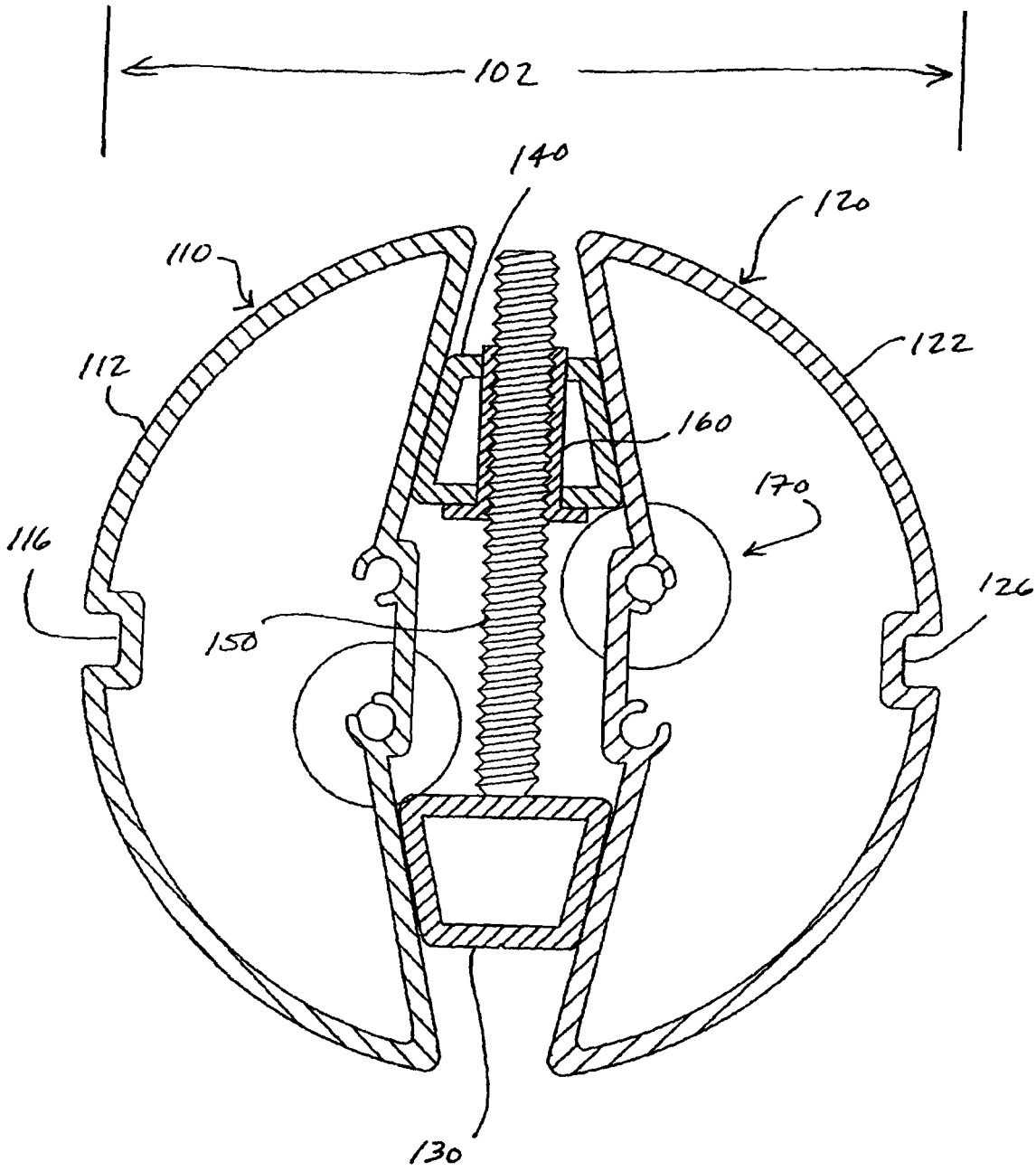
FIG. 4 is a cross-sectional illustration of the splicing apparatus as seen along line 4-4 in FIG. 3.

The splicing apparatus 100 is shown assembled in FIGS. 3 and 4. As illustrated, the means 170 at each end of the splicing apparatus may be arranged to prevent the components of the splicing apparatus 100 from moving longitudinally relative to one another. In other words, the means 170 may be arranged to cause the assembled splicing apparatus 100 to move together as a unit when longitudinally inserted into the ends of tubes as described herein.

As will be understood from the cross-sectional view of FIG. 4, a rotation of the third movable element (threaded rod) 150 in a first direction will cause the third movable element 150 to move the first and second movable elements (wedges) 130 and 140 away from each other. Such movement of the first and second movable elements 130 and 140 will cause the first and second movable elements 130 and 140 to engage the first and second sloped portions 114*a*, 124*a* and 114*b*, 124*b*, respectively, and force the first and second elongate structures 110 and 120 apart. The surfaces 114*a* and 124*a*, and 114*b* and 124*b*, when assembled together form narrowing slots that narrow as they extend outwardly. As the movable element 150 pushes the movable elements 130 and 140 outwardly, the movable elements 130 and 140 engage with the narrowing slots (surfaces 114*a*, 124*a*, 114*b*, 124*b*) and act to push the first and second elongate structures 110 and 120 apart. This movement increases the dimension (the "equivalent diameter") of the splicing apparatus 100 at right angles to the movement of the movable elements 130 and 140. That is, such movement will cause an equivalent diameter 102 of the splicing apparatus 100 to increase or expand. Rotation of the third movable element 150 in the opposite direction may have the opposite effect, causing the equivalent diameter 102 to decrease or contract.

In one embodiment, the wedges of the first and second movable elements 130 and 140 may include a slope or incline of approximately twelve degrees on each side. The relationship between the translational movement (X) of the wedges and outward movement (Y) of each of the first and second elongate structures 110, 120 in response may be expressed as Y=X*TAN (12). If X=1, then Y=TAN (12)=0.2125. However, because the wedges act on both of the first and second elongate structures 110, 120, the effect is 2Y or 0.425. Thus, for every distance unit the third movable element 150 moves the wedges apart, the wedges push the first and second elongate structures 110, 120 apart about 0.425 distance units, for a twelve degree slope as the distance may vary according to a particular design. As mechanical advantage is inversely proportional to movement, for every force unit applied to and thus by the third movable element 150 to the wedges, the wedges will apply about 2.352 force units on the first and second elongate structures 110, 120. This mechanical advantage helps to ensure a sufficient frictional or pressure engagement of the splicing apparatus 100 with the tube sections.

Figure 5:
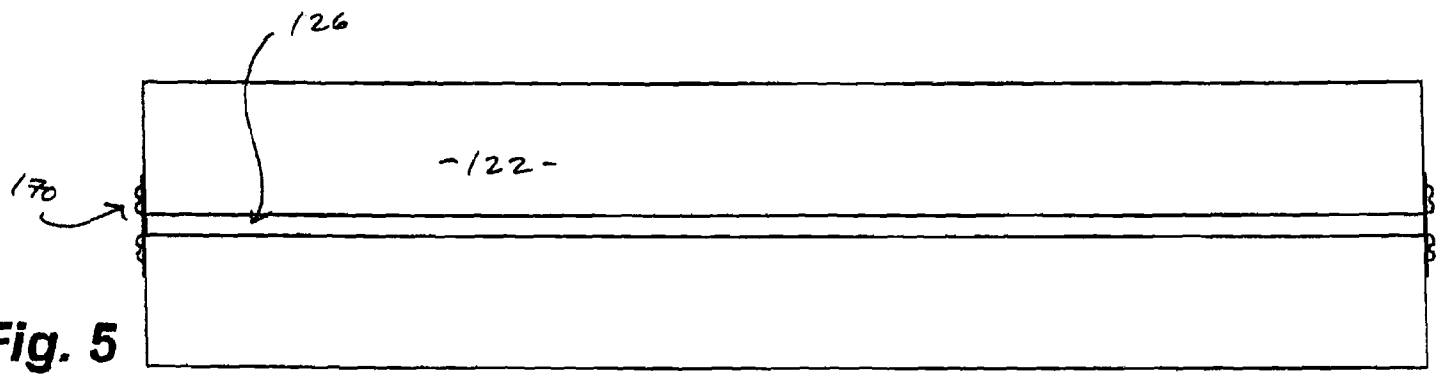
FIG. 5 is a side view of the splicing apparatus shown in FIG. 3.
Figure 6:
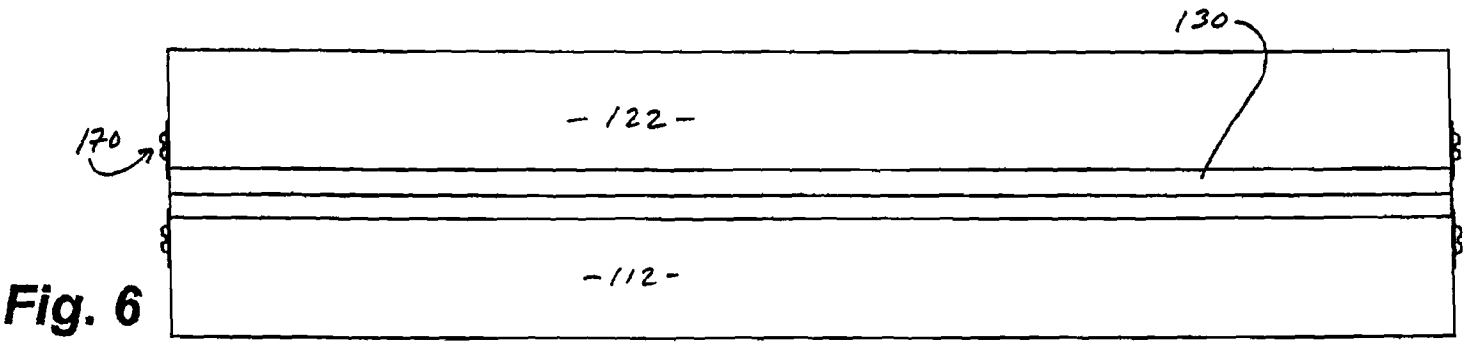
FIG. 6 is a bottom view of the splicing apparatus shown in FIG. 3.
Figure 7:
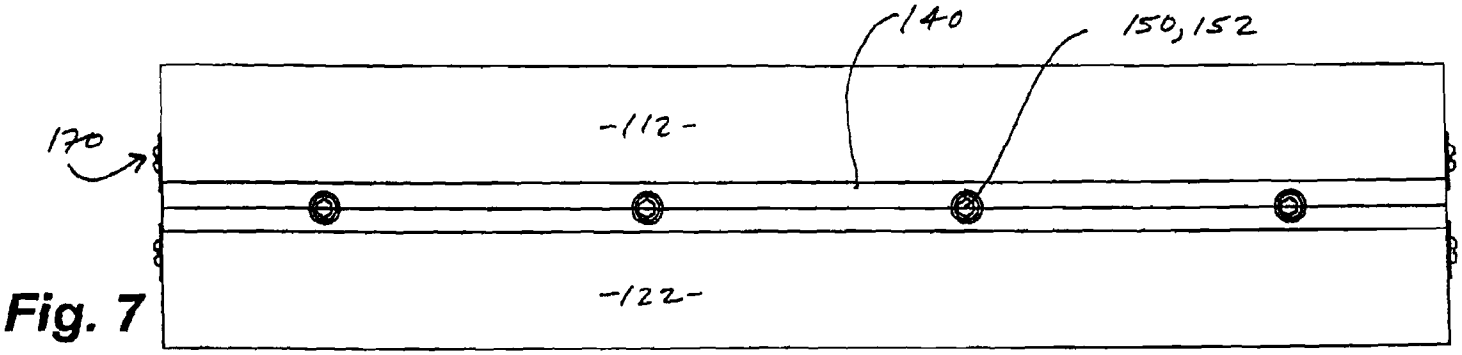
FIG. 7 is a top view of the splicing apparatus shown in FIG. 3.

FIG. 5 is a side view of the splicing apparatus 100 as shown in FIG. 4. FIG. 6 is a bottom view of the splicing apparatus 100 as shown in FIG. 4. FIG. 7 is a top view of the splicing apparatus 100 as shown in FIG. 4. As is visible in the top view of FIG. 7, the third movable element 150 may include an engagement feature 152 for facilitating rotation of the third movable element 150. As shown, the engagement feature 152 may be a recess configured to receive a bit of a tool, such as a hexagonal bit, a star bit, a Philips screwdriver bit, a flat screwdriver bit, or any other suitable bit. Further, the engagement feature may be a relief configured to be received by a suitable tool, such as a socket or the like.

Figure 8A:
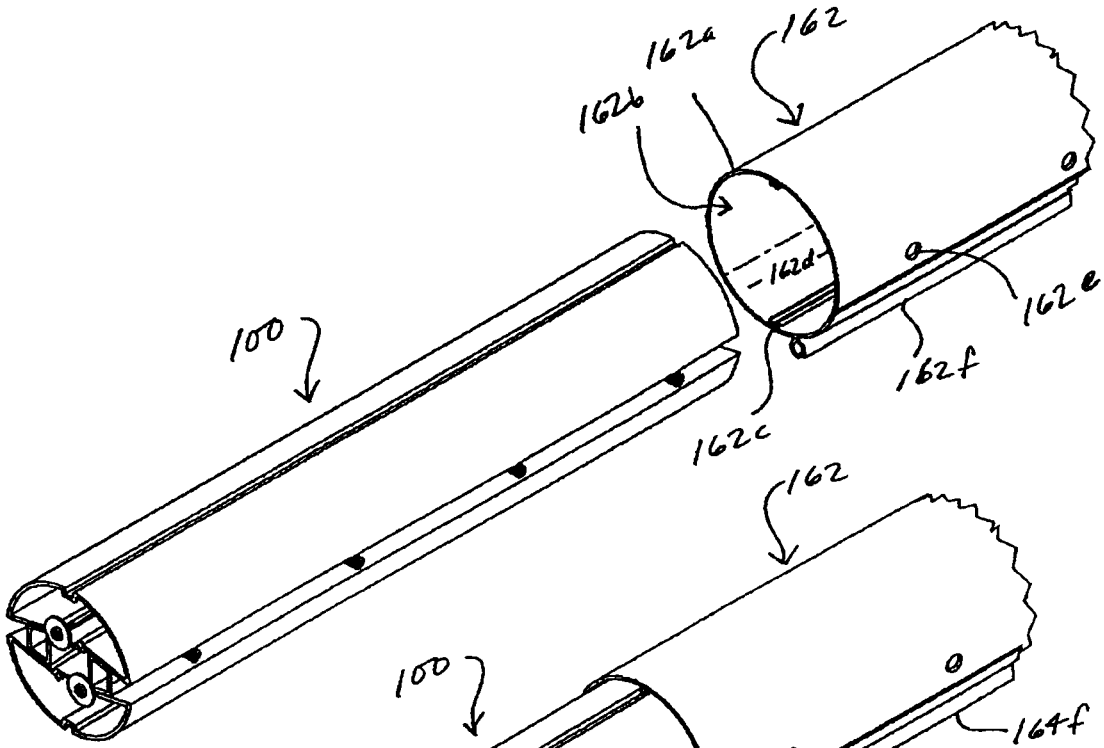
FIGS. 8A-C are partial cutaway perspective views illustrating various stages of using the splicing apparatus of FIGS. 2-7 to interconnect two tubes.
Figure 8B:
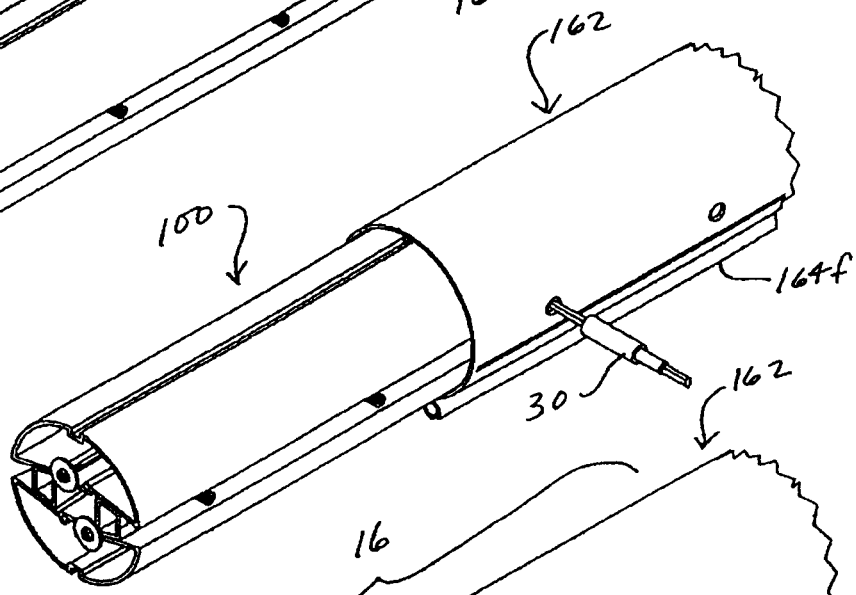
Figure 8C:
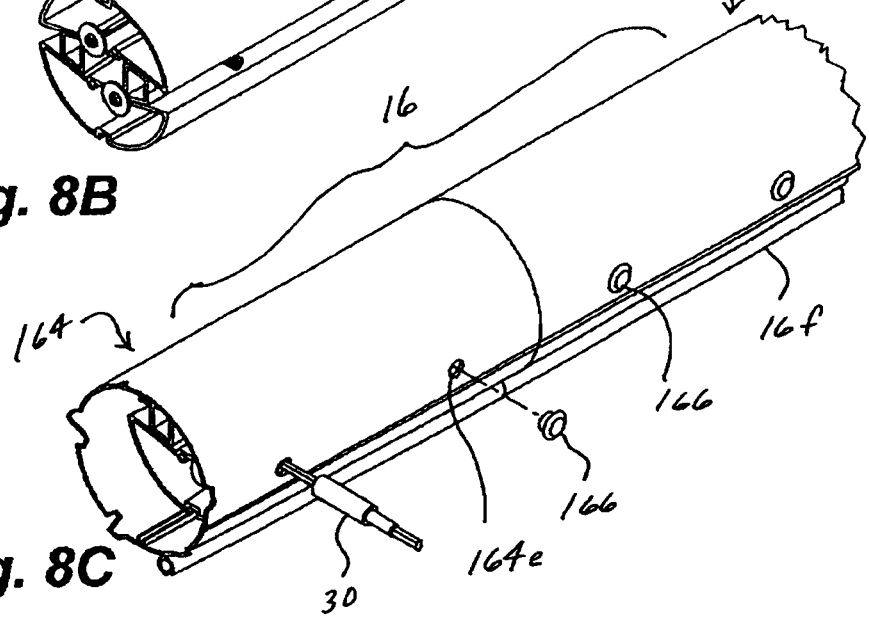

FIGS. 8A-C are partial cutaway perspective views illustrating various stages of using the splicing apparatus of FIGS. 2-7 to interconnect a first leading edge support tube section 162 with a second leading edge support tube section 164 to form a leading edge support tube 16. In the embodiment shown, each section 162, 164 and thus the assembled tube 16 include a pool cover engagement means 16*f*. It should be understood that such engagement means is entirely a matter of design choice for a given application. Also, although only two sections are illustrated as forming the leading edge support tube 16, it should be understood that any number of sections may be interconnected using plural splicing apparatus.

First, the splicing apparatus 100 may be assembled as described above. As illustrated in FIG. 8A, the first leading edge support tube section 162 includes at least one end 162*a* with an opening 162*b* that is configured to receive the splicing apparatus 100. In particular, the end 162*a* may be sufficiently hollow to allow the splicing apparatus to be partially inserted therein. At least a portion of the end 162*a* configured to receive the splicing apparatus 100 may include one or more mating structures 162*c*, on an inner surface 162*d*, corresponding to and configured to cooperate with the rotational engagement structures 116, 126 of the splicing apparatus 100. The mating structure(s) 162*c* may cooperate with the rotational engagement structure(s) to provide alignment of the splicing apparatus 100 within the first leading edge support tube section 162, and may also prevent any substantial relative rotation between the splicing apparatus 100 and the first leading edge support tube section 162. Thus, the mating structure(s) 162*c* may also facilitate transfer of torque over spliced sections 162 and 164 during use once the splicing apparatus 100 is fully installed.

The first leading edge support tube section 162 may include one or more apertures 162*e* corresponding to the one or more third movable elements 150 employed in the splicing apparatus 100. Thus, aligning the splicing apparatus 100 within the first leading edge support tube section 162 and preventing relative rotation therebetween may facilitate locating the aperture(s) 162*e* over the third movable element (s) 150 to allow a tool bit 30 to be inserted into engagement with the feature 152 of each third movable element 150.

As illustrated in FIG. 8B, one of the third movable elements 150 may be at least partially moved to cause the splicing apparatus to increase its equivalent diameter while inside the first leading edge support tube section 162. This may provide a way to keep the splicing apparatus within the first leading edge support tube section 162 while the second leading edge support tube section 164 is slid over the splicing apparatus 100, or the splicing apparatus is slid into the second leading edge support tube section 164, as illustrated in FIG. 8C. Alternatively, the splicing apparatus 100 may be held in place relative to the first leading edge support tube section 162, for example, using the tool bit 30, while the second leading edge support tube section 164 is slid over the splicing apparatus 100, or the splicing apparatus is slid into the second leading edge support tube section 164.

It should be understood that when the splicing apparatus 100 includes a plurality of third movable elements 150, the third movable elements 150 may be moved incrementally to gradually increase the equivalent diameter 152 of the splicing apparatus 100 within the tube sections 162, 164. Alternatively or additionally, the third movable elements may be moved sequentially and alternately, starting with one of the third movable elements nearest the joining ends of the tube sections 162, 164, and continuing in order away from the ends, alternating between movable elements disposed within the different tube sections 162, 164.

Figure 9:
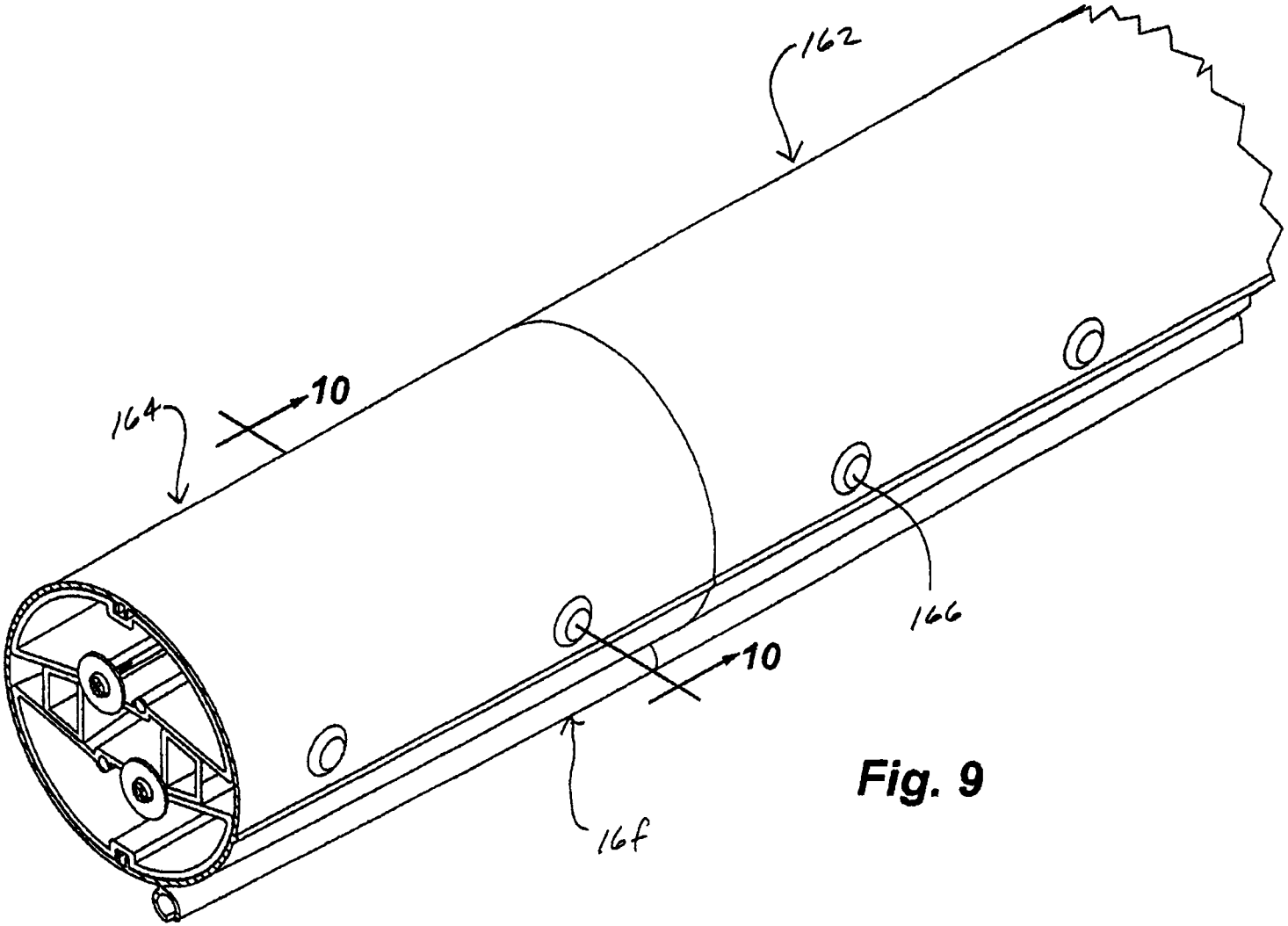
FIG. 9 is a partial cutaway perspective view of the splicing apparatus of FIGS. 2-7 as a completed assembly with the two tubes.
Figure 10:
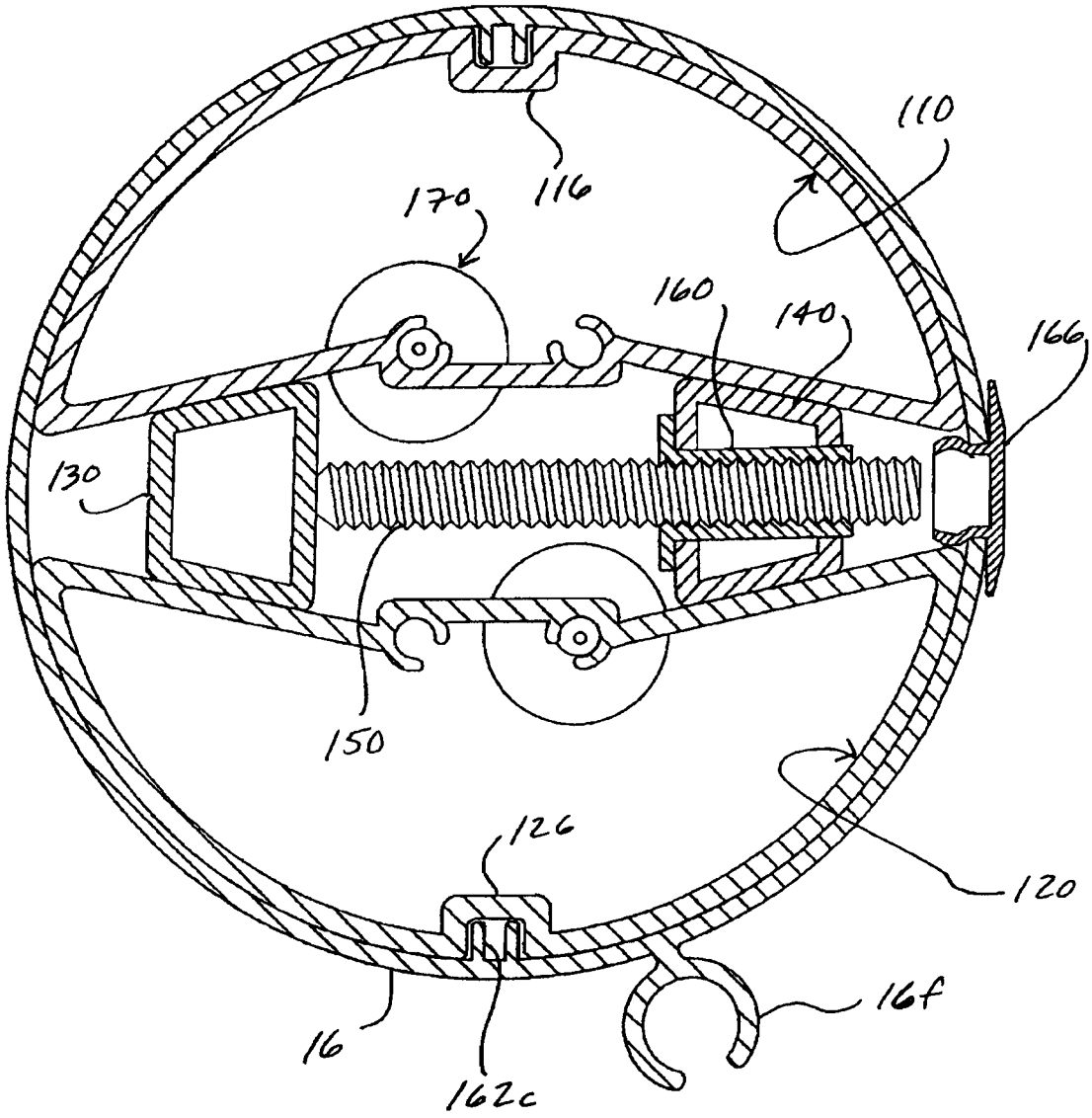
FIG. 10 is a cross-sectional illustration of the completed assembly as seen along line 10-10 in FIG. 9.

Once each third movable element 150 has been moved sufficiently to securely engage the inner surfaces of the tube sections 162, 164, a plug cap 166 may be inserted to close the respective aperture, as illustrated in FIG. 8C. The tube sections 162, 164 interconnected to form the leading edge support tube 16 is illustrated as a completed assembly in FIG. 9. FIG. 10 shows a cross-sectional view as seen from section line 10-10 in FIG. 9.

The plug cap 166 may be configured to engage the respective tube section 162, 164, as illustrated in FIG. 10. Alternatively or additionally, the plug cap 166 may be configured to engage the respective third movable element 150, for example, being threaded thereon. The plug cap 166 may be configured to rest flush with the outer surface of the respective tube section 162, 164, or may include a collar to rest on the outer surface as illustrated in FIGS. 8C, 9 and 10.

Figure 11:
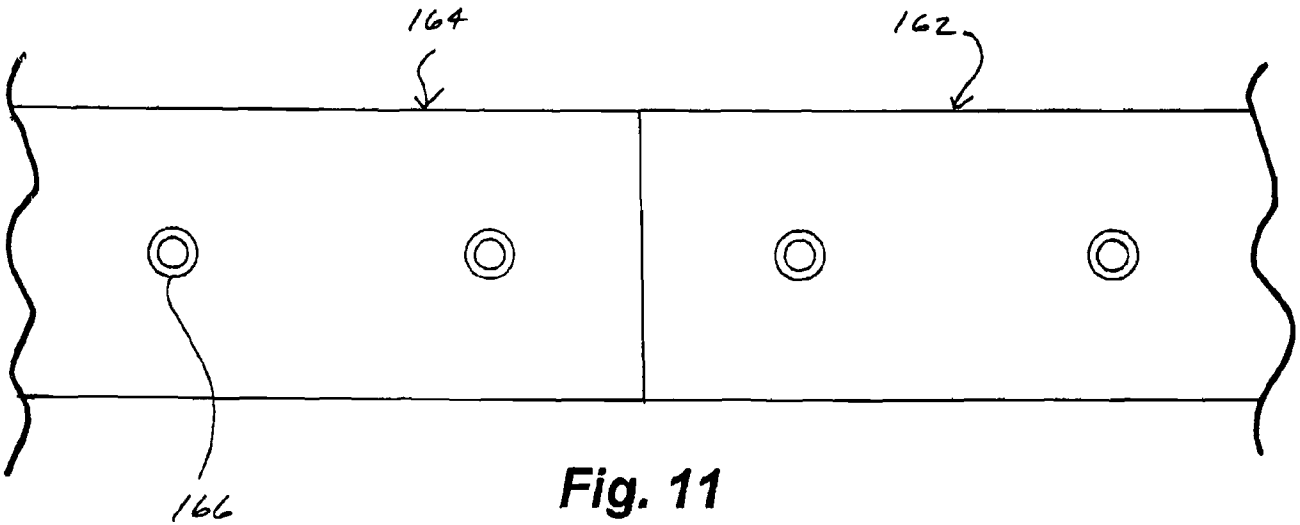
FIG. 11 is a partial cutaway top view of the completed assembly.
Figure 12:
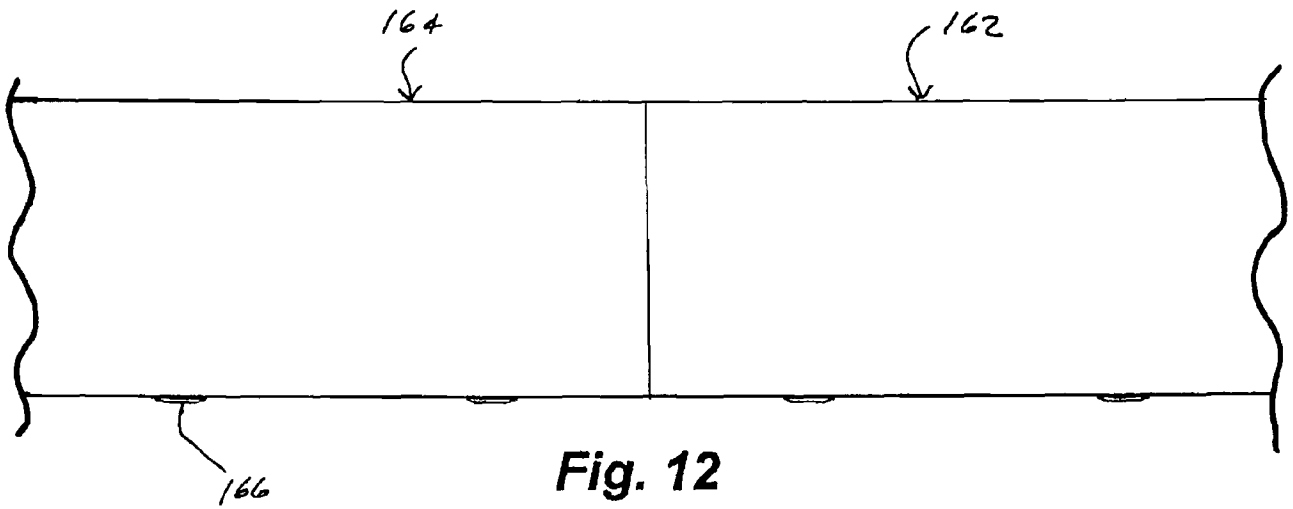
FIG. 12 is a partial cutaway side view of the completed assembly.

FIG. 11 illustrates a partial cutaway top view of the completed assembly, and FIG. 12 illustrates a partial cutaway side view of the completed assembly.

It should be understood from the foregoing description that various principles may be employed to achieve substantially similar splicing apparatus. For example, while only one of the first and second movable elements is shown as engaging the threads of the third movable element, it should be understood that modification to have both the first and second movable elements engage the threads of the third movable element is contemplated as well. For example, respective portions of the third movable element may have threads in opposite directions for engaging the first and second movable elements. Also, while the first and second movable elements are shown as being moved apart to increase the equivalent diameter of the splicing apparatus, it should be understood that the first and second elements may be moved toward one another to achieve the same result, for example, by changing the directions of the sloping portions of the radially inner surfaces and the directions of the wedge structures. In general, such modifications that do not depart form the general principles illustrated by this and the other embodiments described herein should be understood as encompassed by this disclosure.

Figure 13:
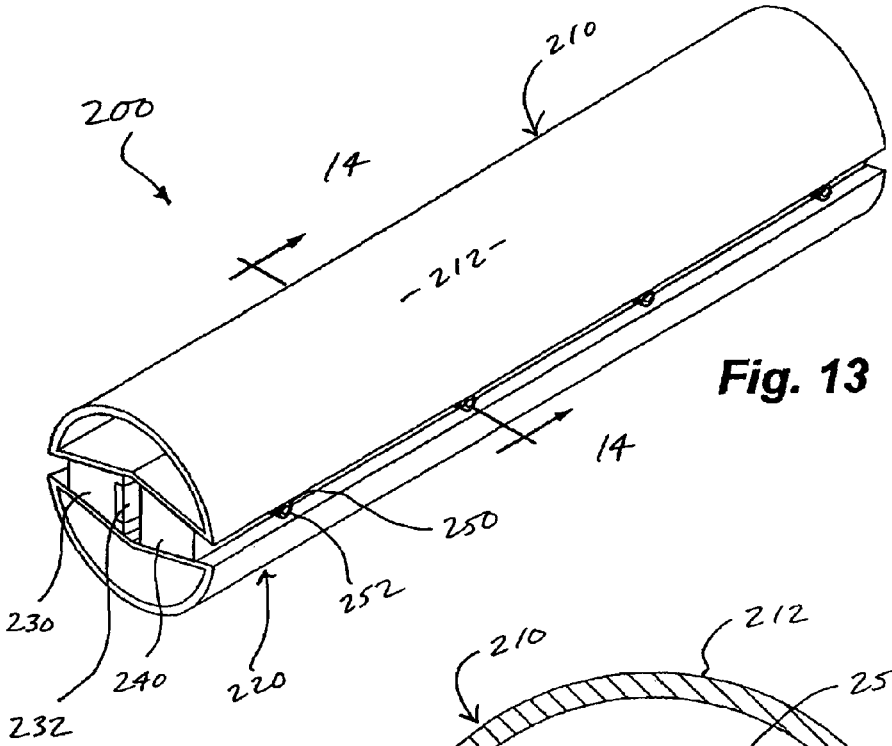
FIG. 13 is a perspective view of another embodiment of a splicing apparatus for interconnecting tubes.
Figure 14:
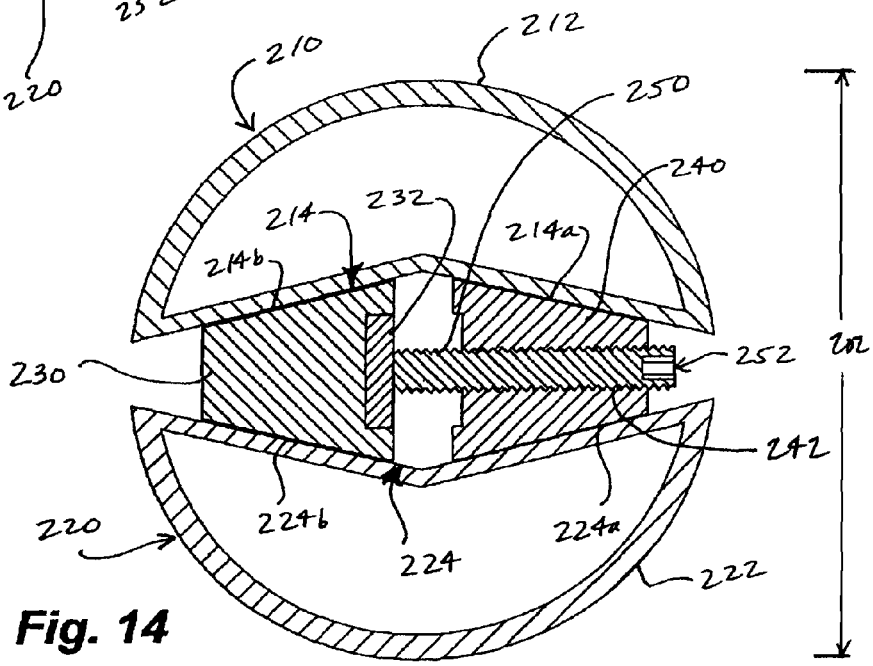
FIG. 14 is a cross-sectional illustration of the splicing apparatus as seen along line 14-14 in FIG. 13.

FIG. 13 is a perspective view of another embodiment of a splicing apparatus 200 for interconnecting tubes. FIG. 14 is a cross-sectional view as seen along section line 14-14 in FIG. 13. As shown, the splicing apparatus 200 may include a first longitudinally elongate structure 210. The first elongate structure 210 may include or define a first radially outer surface 212 and a first radially inner surface 214.

The first radially inner surface 214 may include a first sloped portion 214*a* and a second sloped portion 214*b*. As with the embodiment discussed above with respect to FIGS. 2-7, the first and second sloped portions 214*a*, 214*b* may be described as sloping radially outward in a direction toward each other.

The splicing apparatus 200 may include a second longitudinally elongate structure or member 220. As with the first elongate structure 210, the second elongate structure may include or define a second radially outer surface 222 and a second radially inner surface 224. The second radially inner surface 224 may similarly include a first sloped portion 224*a* and a second sloped portion 224*b*.

The splicing apparatus 200 may include at least one first movable element 230. As discussed above, the first movable element 230 may be in the form of a trapezoidal wedge, which may be solid as shown, hollow or otherwise, as appropriate or desired. It should be understood that the wedge may be triangular or any other suitable shape as well. In the case of the solid, trapezoidal wedge first movable element 230 shown, a substantially flat top may provide a suitable bearing surface, or a plate 232 may be inserted or affixed to provide a material more resistant to rotational wear, for example, such as steel.

The splicing apparatus 200 may include at least one second movable element 240. The second movable element 240 may also be in the form of a trapezoidal wedge, which may be solid as shown, hollow or otherwise, as appropriate or desired. It should be understood that the wedge may be triangular or any other suitable shape as well. In the case of the solid, trapezoidal wedge second movable element 240 shown, a threaded bore 242 may be formed therethrough. Alternatively, a tee nut as described above may be used.

The splicing apparatus 200 may include at least one third movable element 250. The third movable element 250 may be in the form of a threaded rod. The third movable element 250 may be configured as such to engage the threaded bore 242 with its threads and to engage the first movable element 230, for example, by contacting the bearing surface or plate 232.

As discussed above, the first and/or second movable elements 230, 240 may each be formed by a single respective elongate element or by a plurality of respective elements, as appropriate or desired. Further, although a plurality of third movable elements 250 is depicted, it should be understood that employing a single third movable element is not excluded.

Although not illustrated in FIGS. 13 and 14, it should be understood that the splicing apparatus 200 may further include means for longitudinally securing the first elongate structure 210, the second elongate structure 220, the first movable element 230 and the second movable element 240 together, as discussed above.

As will be understood from the cross-sectional view of FIG. 14, a rotation of the third movable element (threaded rod) 250 in a first direction will cause the third movable element 250 to move the first and second movable elements (wedges) 230 and 240 away from each other. Such movement of the first and second movable elements 230 and 240 will cause the first and second movable elements 230 and 240 to engage the first and second sloped portions 214*a*, 224*a* and 214*b*, 224*b*, respectively, and force the first and second elongate structures 210 and 220 to move apart. That is, such movement will cause an equivalent diameter 202 of the splicing apparatus 200 to increase or expand. Rotation of the third movable element 250 in the opposite direction may have the opposite effect, causing the equivalent diameter 202 to decrease or contract.

Although this embodiment is not illustrated as including rotational engagement structures as discussed above, it should be understood that it may include such features. Further, although the alignment and anti-rotation benefits would be reduced once the equivalent diameter of the splicing apparatus is increased or expanded as described herein, the spaces between the first sloped portions 214*a*, 224*a* of the first and second elongate structures 210, 220 and between the second sloped portions 214*b*, 224*b* of the first and second elongate structures 210, 220 may serve such a purpose for engaging suitable mating features inside the tubes to be interconnected. In other words, such spaces may provide such benefits at least when the splicing apparatus 200 is initially inserted into each tube, before increasing the equivalent diameter of the splicing apparatus 200.

Figure 15:
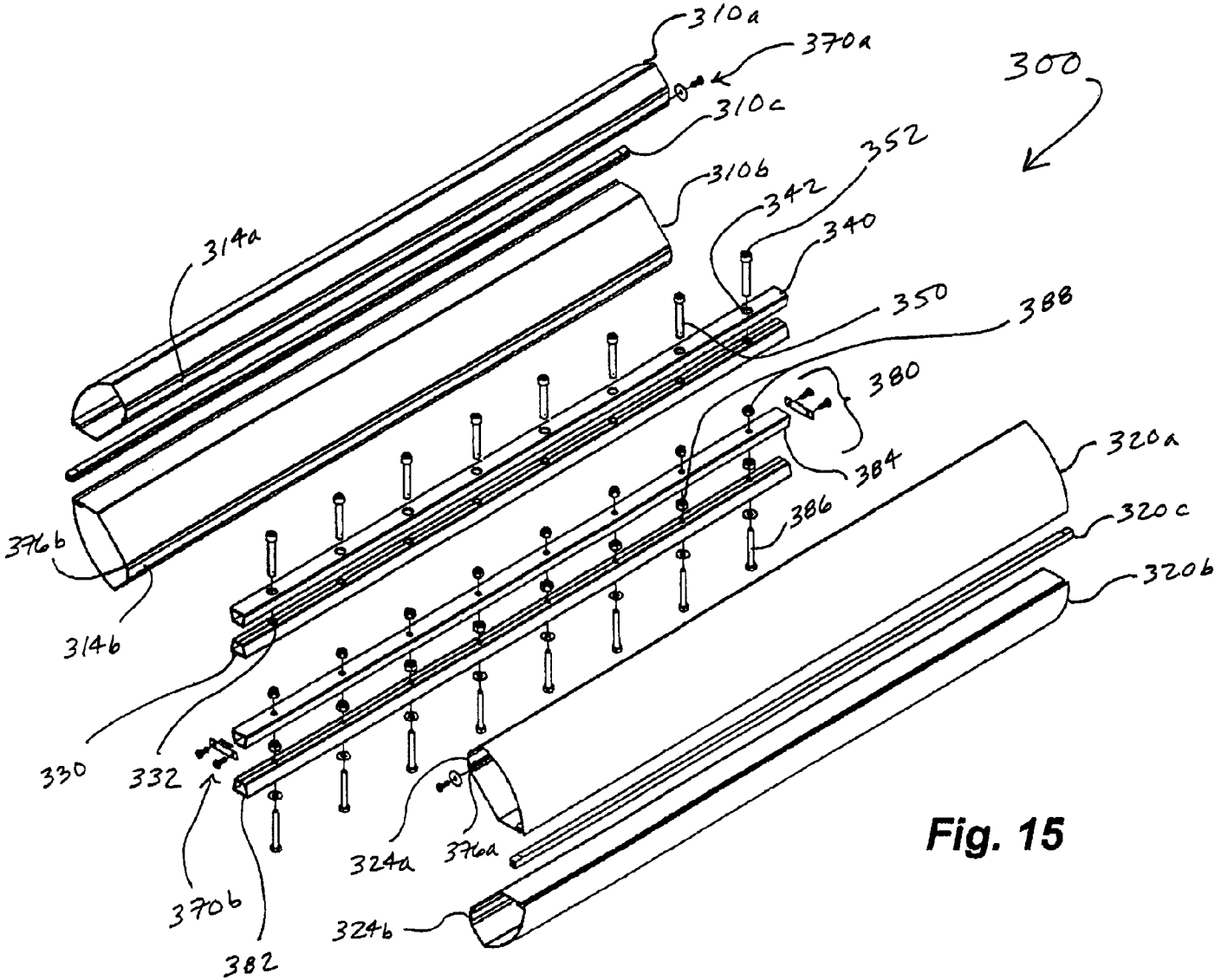
FIG. 15 is an exploded illustration of another embodiment of a splicing apparatus for interconnecting tubes.

FIG. 15 is an exploded illustration of another embodiment of a splicing apparatus 300 for interconnecting tubes. As shown, the splicing apparatus 300 may include a first longitudinally elongate structure or member 310. The first elongate structure 310 may include or define a first radially outer surface 312 and a first radially inner surface 314. Differing from the embodiments described above, the first elongate structure 310 may comprise a first section 310*a* secured to a second section 310*b* by an interconnector 310*c*, discussed in more detail below with respect to FIGS. 17, 18, 19 and 19A.

Figure 16:
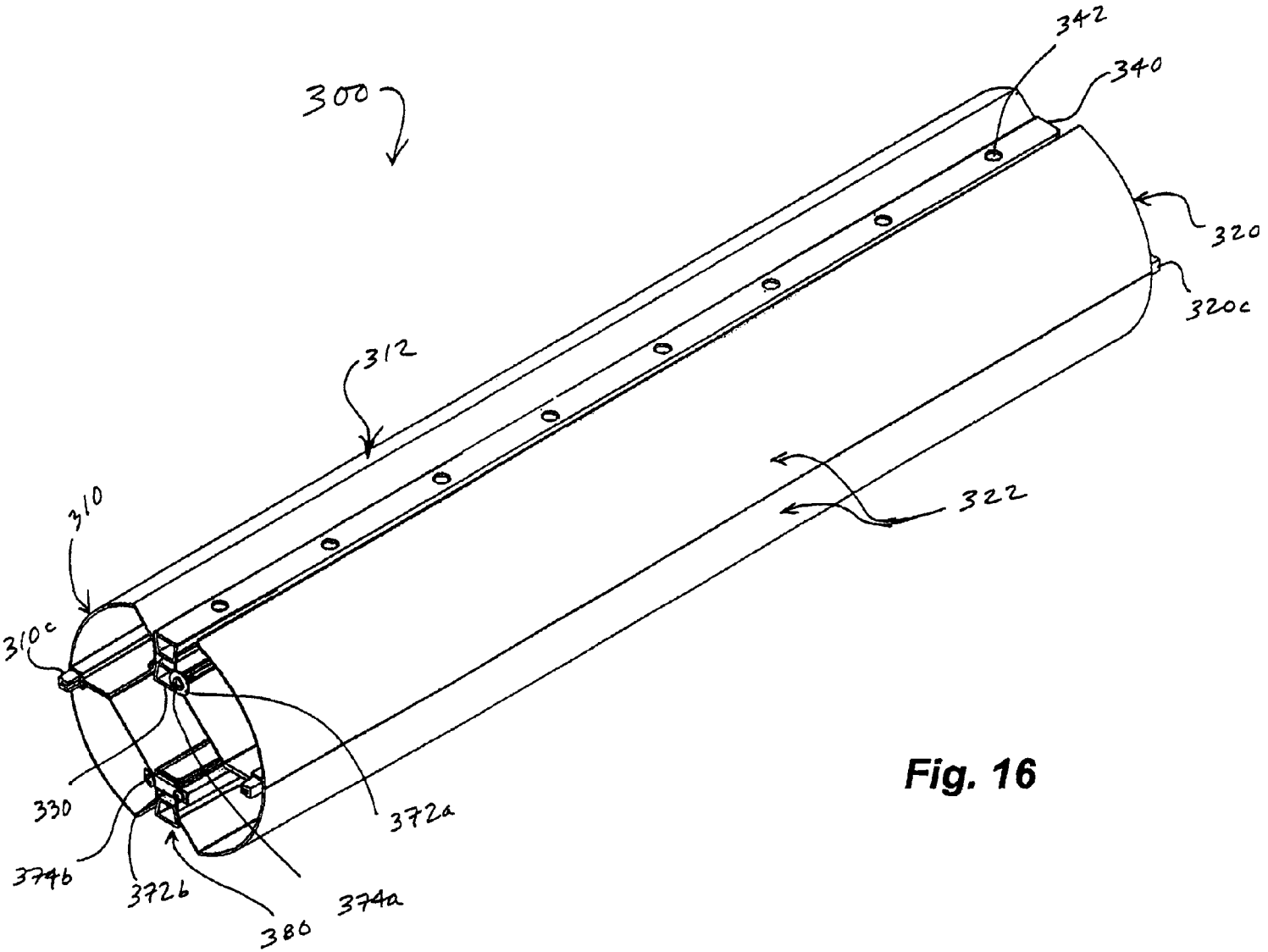
FIG. 16 is a perspective view of the splicing apparatus shown in FIG. 15 as assembled.

The splicing apparatus 300 may include a second longitudinally elongate structure or member 320. As with the first elongate structure 310, the second elongate structure may include or define a second radially outer surface 322 and a second radially inner surface 324. The second elongate structure 320 may also comprise a first section 320*a* secured to a second section 320*b* by an interconnector 320*c*, discussed further below. As will be appreciated from FIGS. 15-17, the first radially inner surface 314 may be defined by surfaces 314*a* and 314*b*, while the second radially inner surface 324 may be defined by surfaces 324*a* and 324*b*. Further, it will be appreciated that the surfaces 314*a*, 314*b*, 324*a* and 324*b* may include chamfered edges (surfaces), which may be sloped suitably for engagement with movable elements, as described below.

The splicing apparatus 300 may include at least one first movable element 330. The first movable element 330 may be in the form of a trapezoidal wedge, which may be hollow as shown, solid or otherwise, as appropriate or desired. It should be understood that the wedge may be triangular or any other suitable shape as well. In the case of the hollow, trapezoidal wedge first movable element 330 shown, benefits of weight reduction and strength may be obtained. Further, a substantially flat top and bottom as shown may facilitate the formation of holes 332 therethrough.

The splicing apparatus 300 may include at least one second movable element 340. The second movable element 340 may also be in the form of a trapezoidal wedge, which may be hollow as shown, solid or otherwise, as appropriate or desired. It should be understood that the wedge may be triangular or any other suitable shape as well. In the case of the hollow, trapezoidal wedge second movable element 340 shown, a substantially flat top and bottom as shown may facilitate the formation of holes 342 therethrough to receive a threaded insert 344.

Figure 17:
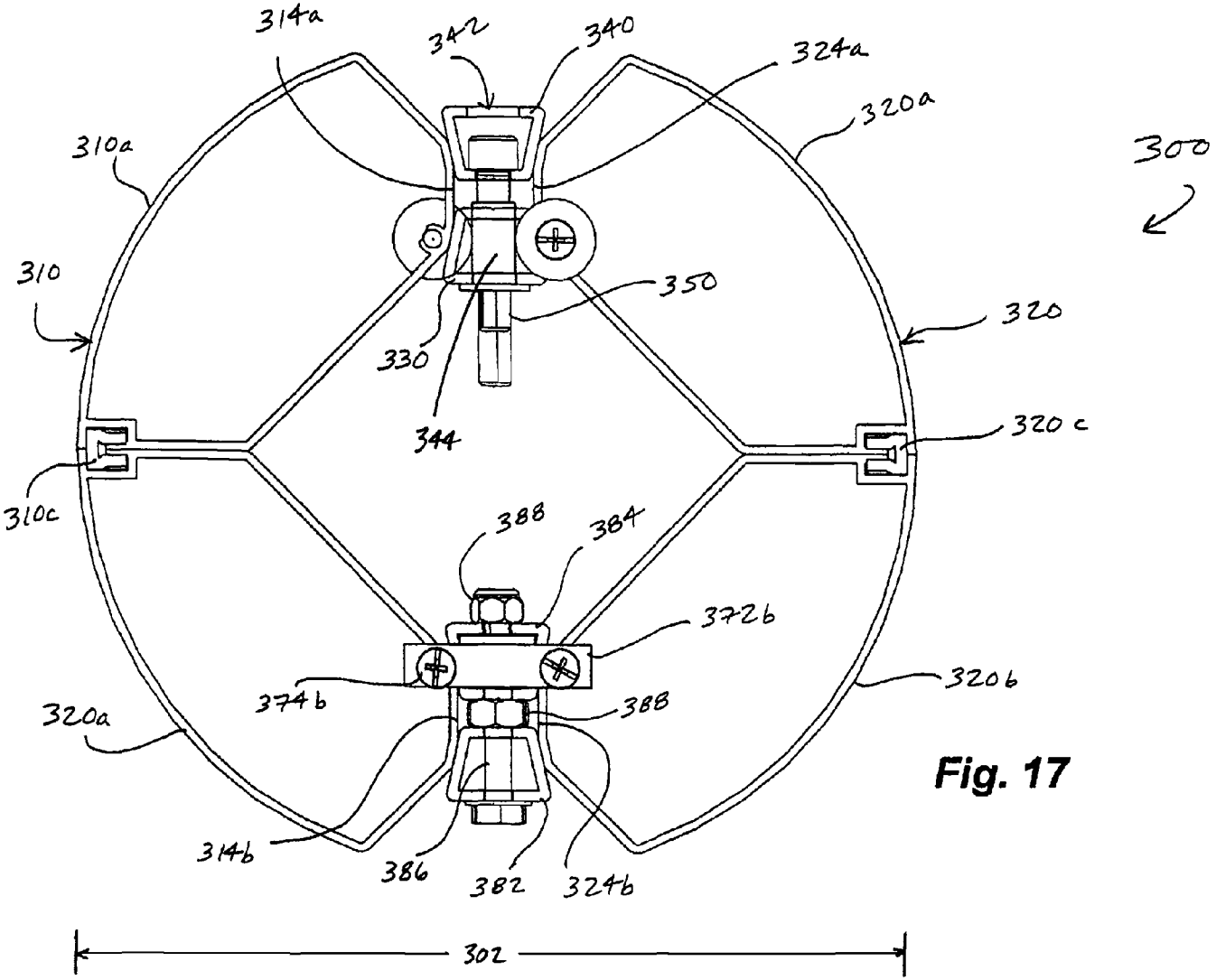
FIG. 17 is a cross-sectional illustration of the splicing apparatus as seen along line 17-17 in FIG. 16.

The splicing apparatus 300 may include at least one third movable element 350. The third movable element 350 may be in the form of a threaded bolt including a head 352. The third movable element 350 may be configured as such to engage the threaded insert 344 of the second movable element 340, while the head 352 of the third movable element 350 engages the first movable element 330, as shown in FIG. 17.

The first elongate structure 310 and the second elongate structure 320 may be formed as extrusions of aluminum or other suitable material. The first movable element 330 and the second movable element 340 may be made of extruded aluminum, acetal or other suitable material that provides a high bending moment of inertia.

It should be understood from FIG. 15 that the first and/or second movable elements 330, 340 may be formed by a single respective elongate element or by a plurality of respective elements, as appropriate or desired. Further, although a plurality of third movable elements 350 is depicted, it should be understood that employing a single third movable element is not excluded.

The splicing apparatus 300 may further include means 370*a*, 370*b* for longitudinally securing the first elongate structure 310, the second elongate structure 320, the first movable element 330 and the second movable element 340 together. As discussed above, the means 370*a* may comprise a washer 372*a*, an associated screw 374*a* and a corresponding bore 376*a* formed on at least one of the first elongate structure 310, the second elongate structure 320, the first movable element 330 and the second movable element 340. The means 370*b* may comprise a plate 372*b*, an associated pair of screws 374*b* and a corresponding pair of bores 376*b* formed, for example, on the first elongate structure 310 and the second elongate structure 320, as shown in FIG. 17. By providing means 370*a* or 370*b* at each end of the splicing apparatus, the splicing apparatus may be held together to move longitudinally as a unit. It should be understood that means 370*a* may be used in place of means 370*b* as well.

It should be understood that the first elongate structure 310 and/or the second elongate structure 320 may be configured to allow the surfaces 314*a* and 324*a* to be moved apart while the surfaces 314*b* and 324*b* remain a same or substantially same distance apart. For example, as the third movable element 350 is rotated to move the first and second movable elements 330 and 340 toward each other, the first and second movable elements 330 and 340 push radially outward on the chamfered edges of the surfaces 314*a* and 324*a*. The resulting expansion of the splicing apparatus 300 increases the equivalent diameter as the plate 372*b* effectively acts as a hinge. The surfaces 314*b* and 324*b* may cease to be parallel, but generally may remain substantially the same distance apart.

In this embodiment, because only one side (half) of the splicing apparatus 300 is moved, each unit of translation of the movable elements 330 and 340, for a twelve degree slope, results in an outward movement of 0.2125 unit. In terms of force, one unit of input translational force may result in about 4.7 units of outward force. The relatively small amount of outward movement per unit of translational movement of the movable elements 330 and 340 may, in practice, require a relatively tight tolerance for an initial fit inside the tubes to be spliced. Thus, some adjustability for the initial equivalent diameter may be provided by a spacer assembly 380, as discussed below.

As shown, the spacer assembly 380 may include a first wedge element 382, a second wedge element 384, a bolt 386 that extends through both wedge elements 382, 384, and one or more nuts 388. The spacer assembly 380 thus may comprise similar components to simplify manufacture and/or to provide a similar amount of spacing as provided by the movable elements 330, 340 and 350. The spacer assembly 380, however, is intended only to provide a suitable fixed amount of space between the second portions 314*b* and 324*b* of the first and second radially inner surfaces 314 and 324. The amount of space may be adjusted by the thickness of the nut 388 (washer, spacer or the like), for example, and thus set upon assembly of the splicing apparatus 300. Alternatively, the spacer assembly 380 may comprise any suitable structure that may be secured between the second portions 314*b* and 324*b* of the first and second radially inner surfaces 314 and 324, for example, a hollow or solid block of material welded, bonded or otherwise secured to the second portions 314*b* and 324*b*.

Figure 18:
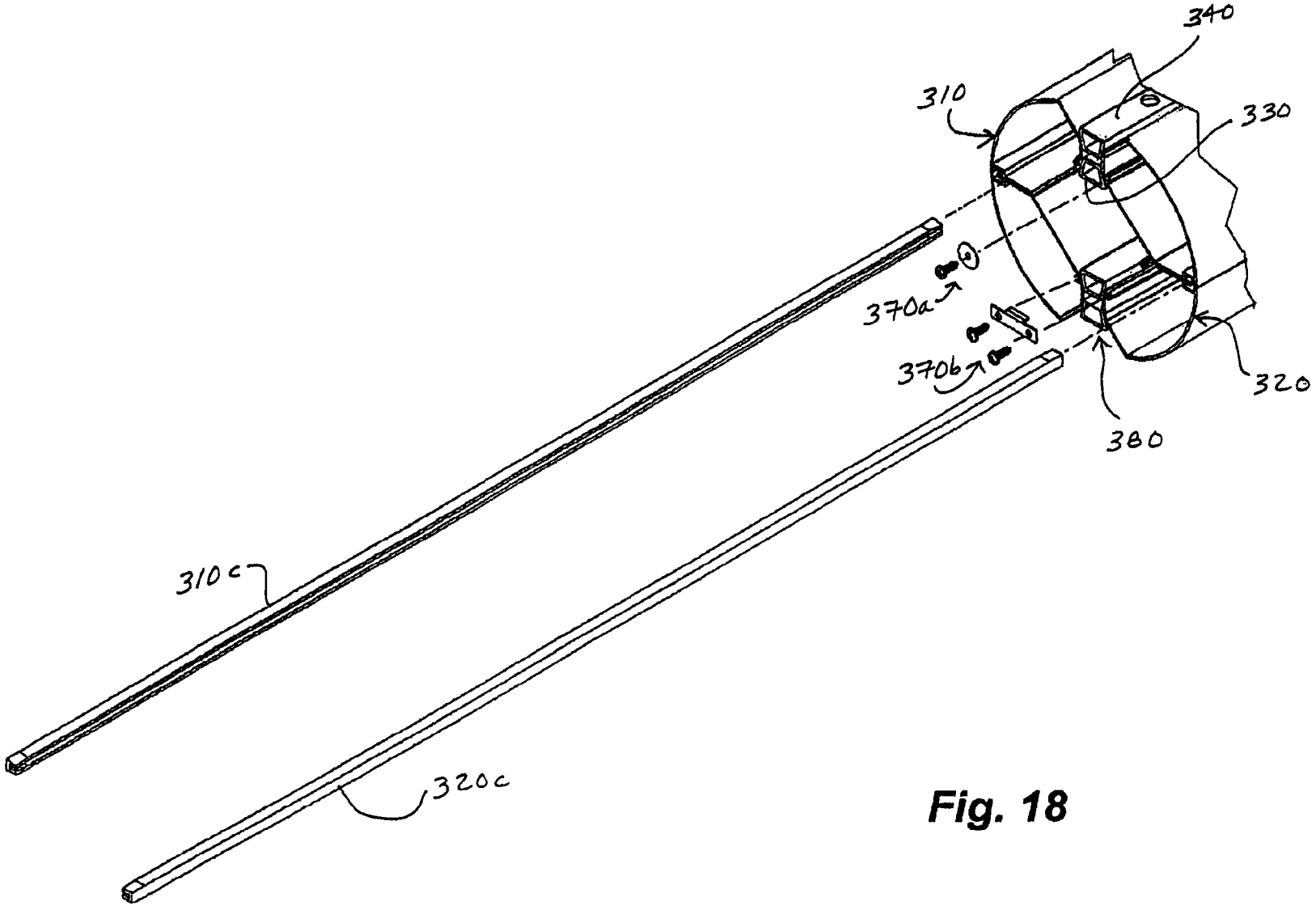
FIG. 18 is a partial cutaway and exploded view of the splicing apparatus shown in FIG. 15.

The splicing apparatus 300 is shown assembled in FIGS. 16, 17 and 19-22, and partially assembled in FIG. 18. As illustrated, the means 370*a* and/or 370*b* at each end of the splicing apparatus may be arranged to prevent the components of the splicing apparatus 300 from moving longitudinally relative to one another. In other words, such means may be arranged to cause the assembled splicing apparatus 300 to move longitudinally together as a unit when longitudinally inserted into the ends of tubes as described herein.

Figure 19B:
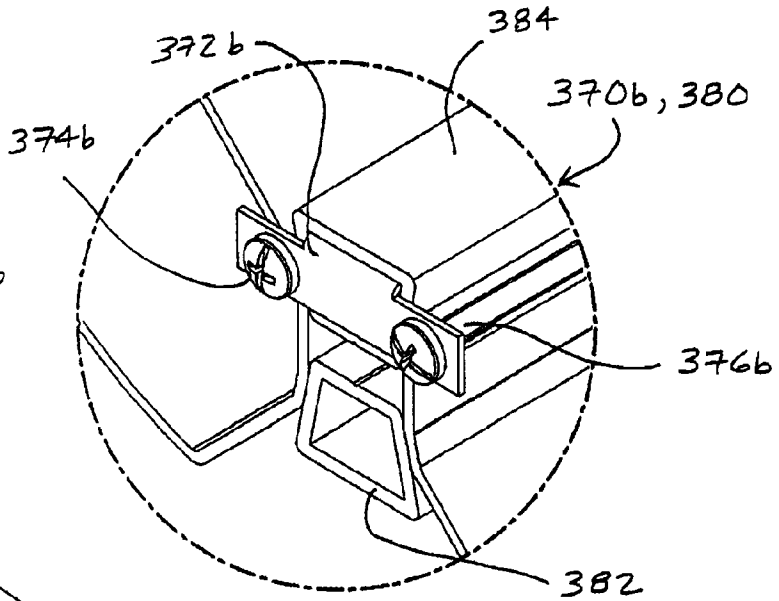
FIG. 19B is an enlarged view of the detail area indicated in FIG. 19.
Figure 19A:
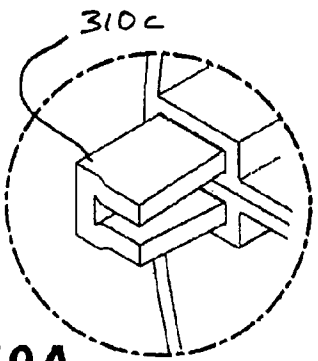
FIG. 19A is an enlarged view of the detail area indicated in FIG. 19.
Figure 19:
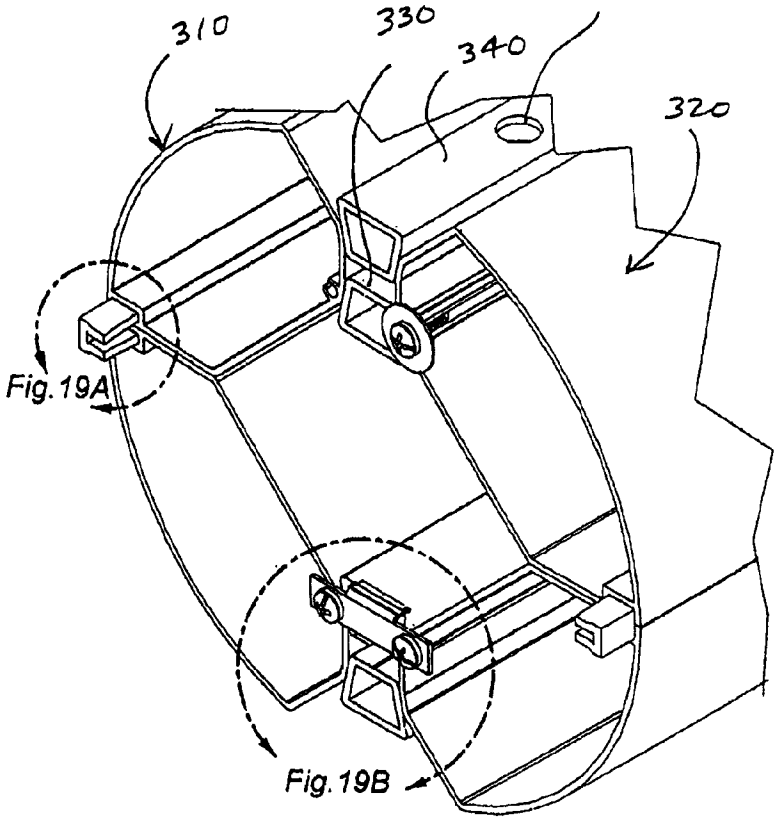
FIG. 19 is a partial cutaway of the splicing apparatus as shown in FIG. 18, but with the apparatus assembled.

As also illustrated in FIG. 18, the interconnectors 310*c* and 320*c* may be slid into apertures formed when the respective first and second sections 310*a*, 310*b* and 320*a*, 320*b* are positioned relative to each other, for example, abutting surfaces as shown in FIGS. 17 and 18. Once inserted, the ends of the interconnectors 310*c* and 320*c* may extend from the respective elongate structures 310 and 320, as shown in FIGS. 19 and 19A. The interconnectors 310*c* and 320*c* may be crimped to secure them in place, squeezing the flanges of the U shaped structure toward each other to prevent the interconnectors 310*c* and 320*c* from being removed.

Although separate rotational engagement structures are not shown for this embodiment, it should be understood that the ends of the interconnectors 310*c* and 320*c* extending from each end of the splicing apparatus 300 may be configured to engage a complementary and cooperating structure disposed on the inner surfaces of the tubes to be interconnected. Such an arrangement may provide the alignment and anti-rotation benefits disclosed above, and may also provide a stop for preventing over-insertion of the splicing apparatus 300 into either of the tubes to be interconnected.

As will be understood from the cross-sectional view of FIG. 17, the first portions 314*a* and 324*a* define a channel or slot therebetween. The first portions 314*a* and 324*a* may initially be substantially parallel with the first and second movable elements (wedges) 330 and 340 including surfaces facing the first portions 314*a* and 324*a* and angled relative thereto. A rotation of the third movable element (threaded bolt) 350 in a first direction will cause the third movable element 350 to move the first and second movable elements (wedges) 330 and 340 toward each other. Such movement of the first and second movable elements 330 and 340 will cause the first and second movable elements 330 and 340 to engage the first portions 314*a* and 324*a*, and force the first and second elongate structures 310 and 320 apart. In other words, as the movable element 350 moves the movable elements 330 and 340 toward each other, the movable elements 330 and 340 engage with the slot (surfaces 314*a*, 324*a*) and act to push the first and second elongate structures 310 and 320 apart. This movement increases the dimension (the "equivalent diameter") of the splicing apparatus 300 at right angles to the movement of the movable elements 330 and 340. That is, such movement will cause an equivalent diameter 302 of the splicing apparatus 300 to increase or expand. Rotation of the third movable element 350 in the opposite direction may have the opposite effect, causing the equivalent diameter 302 to decrease or contract. Pulling the wedges together in this embodiment may be advantageous because bolts operate better under tension than under compression. Also, the distance spanned by the third movable element 350 decreases as the splicing apparatus 300 is tightened to increase the equivalent diameter.

Because both wedges in this embodiment move on one side of the splicing apparatus, the first and second elongate structures 310 and 320 will only move apart half as much for each turn of the bolt, as compared to the embodiment discussed above with respect to FIGS. 2-7 (assuming identical dimensions). Because the force output is inversely proportional to the distance moved, as discussed above, the first and second elongate structures 310 and 320 will push outward against the inner surfaces of the tubes being interconnected with twice as much force, thus applying as much pressure as in the embodiment discussed above with respect to FIGS. 2-7.

Figure 20:
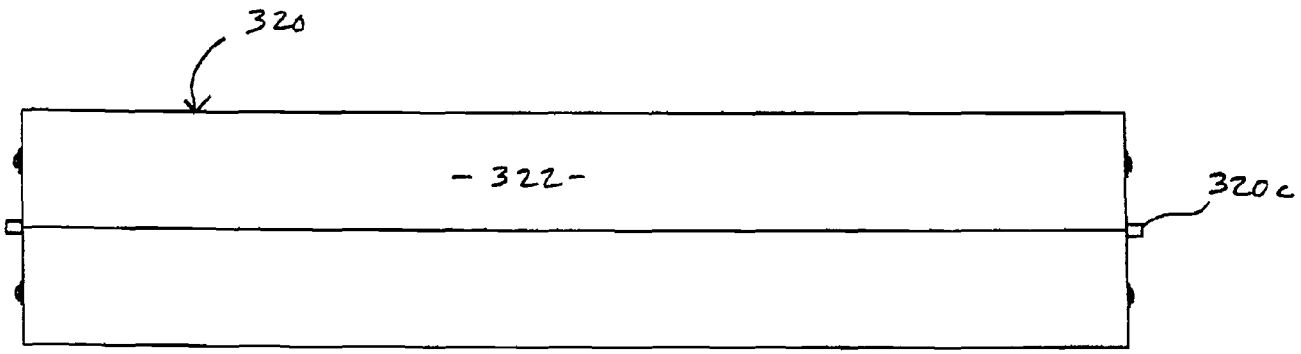
FIG. 20 is a side view of the splicing apparatus shown in FIG. 16.
Figure 21:
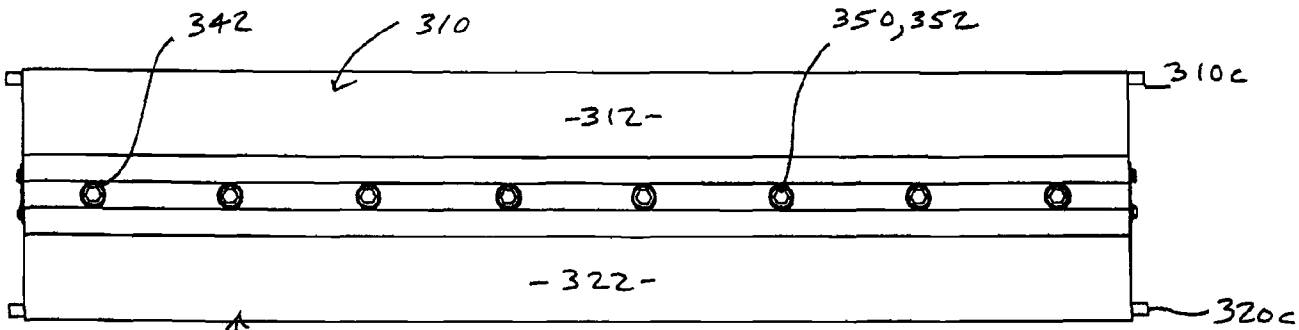
FIG. 21 is a top view of the splicing apparatus shown in FIG. 16.
Figure 22:
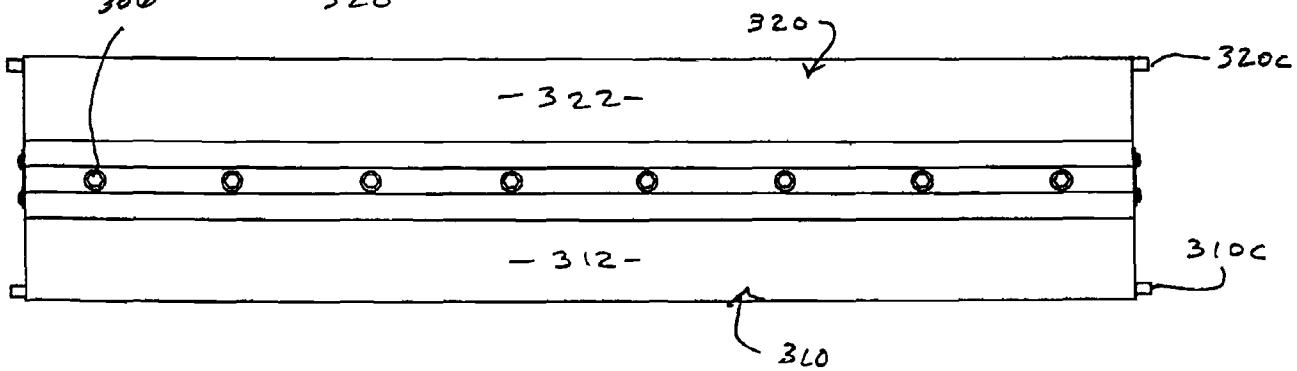
FIG. 22 is a bottom view of the splicing apparatus shown in FIG. 16.

FIG. 20 is a side view of the splicing apparatus 300 as shown in FIG. 17. FIG. 21 is a top view of the splicing apparatus 300 as shown in FIG. 17. FIG. 22 is a bottom view of the splicing apparatus 300 as shown in FIG. 17. As is visible in the top view of FIG. 21, the third movable element 350 may include an engagement feature 352 for facilitating rotation of the third movable element 350. As shown, the engagement feature 352 may be a recess configured to receive a bit of a tool, such as a hexagonal bit, a star bit, a Philips screwdriver bit, a flat screwdriver bit, or any other suitable bit. Further, the engagement feature may be a relief configured to be received by a suitable tool, such as a socket or the like.

FIGS. 23A-D are partial cutaway views illustrating various stages of using the splicing apparatus of FIGS. 15-22 to interconnect a first collection tube section 22 with a second collection tube section 24 to form a collection tube 20. Although only two sections are illustrated as forming the collection tube 20, it should be understood that any number of sections may be interconnected using plural splicing apparatus.

First, the splicing apparatus 300 may be assembled as described above. As illustrated in FIG. 8A, the collection tube section 22 includes at least one end 22*a* with an opening 22*b* that is configured to receive the splicing apparatus 300. In particular, the end 22*a* may be sufficiently hollow to allow the splicing apparatus 300 to be partially inserted therein. The first collection tube section 22 may include one or more apertures 22*e* corresponding to the one or more third movable elements 350 employed in the splicing apparatus 300. Thus, aligning the splicing apparatus 300 within the first collection tube section 22 may be needed to locate the aperture(s) 22*e* over the third movable element(s) 350 to allow a tool bit 30 to be inserted into the engagement feature 352 of each third movable element 350.

Figure 23A:
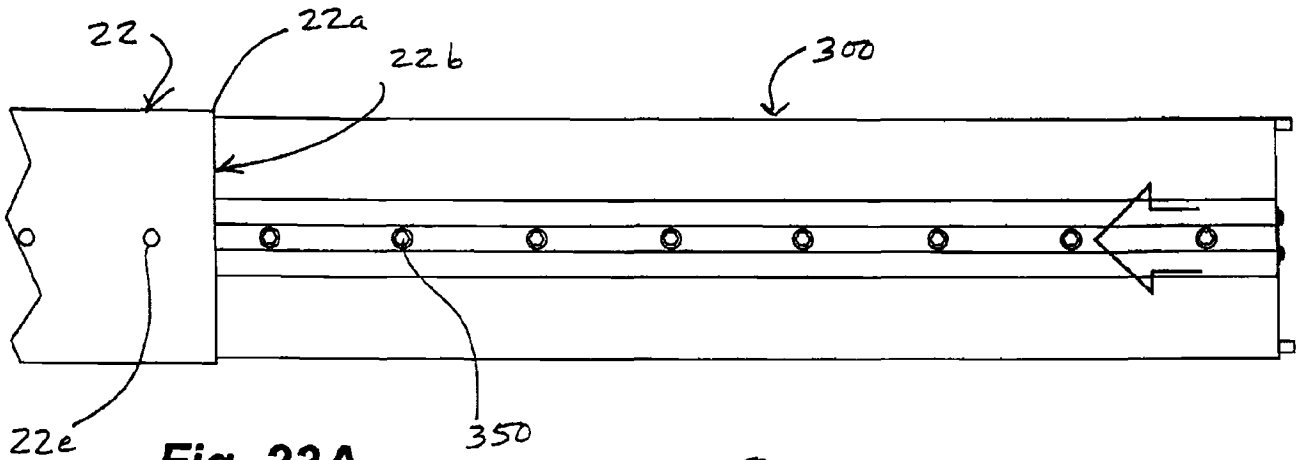
FIGS. 23A-D are partial cutaway views illustrating various stages of using the splicing apparatus of FIGS. 15-22 to interconnect two tubes.
Figure 23B:
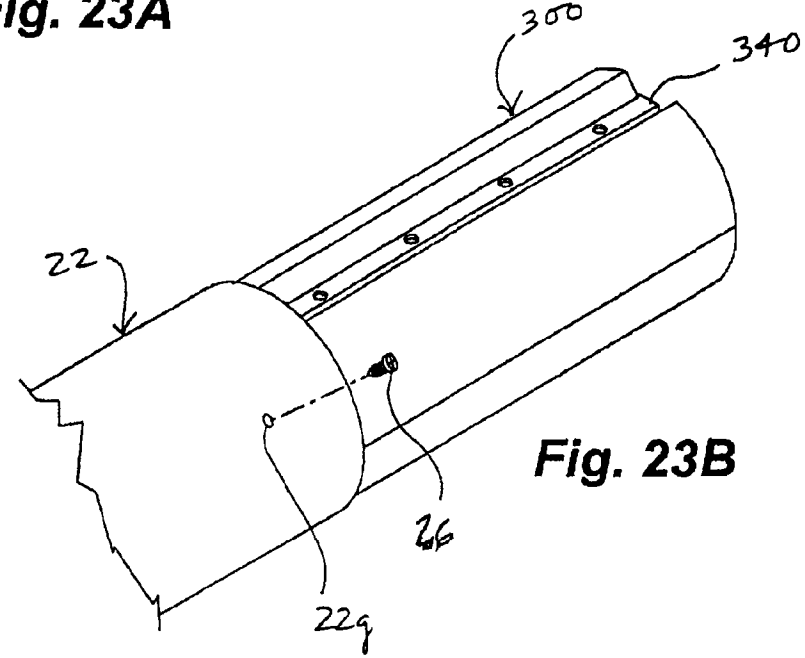

As illustrated in FIG. 23B, once apertures 22*e* are aligned with the third movable elements 350, a temporary fixing means 26, such as a screw, may be inserted through an offset aperture 22*g*, which is offset relative to the apertures 22*e* and the third movable elements 350 to allow engagement with one of the outer surfaces of the splicing apparatus 300. Once engaged, the temporary fixing means 26 may ensure the alignment of the splicing apparatus 300 within the first collection tube section 22, and may also prevent any substantial relative rotation or longitudinal movement between the splicing apparatus 300 and the first collection tube section 22. The splicing apparatus 300 may or may not have a corresponding aperture for the temporary fixing means 26, and the offset aperture 22*g* may be replaced with a placement indicator, or removed altogether to allow an installer to use his judgment for placement of the temporary fixing means 26.

Figure 23C:
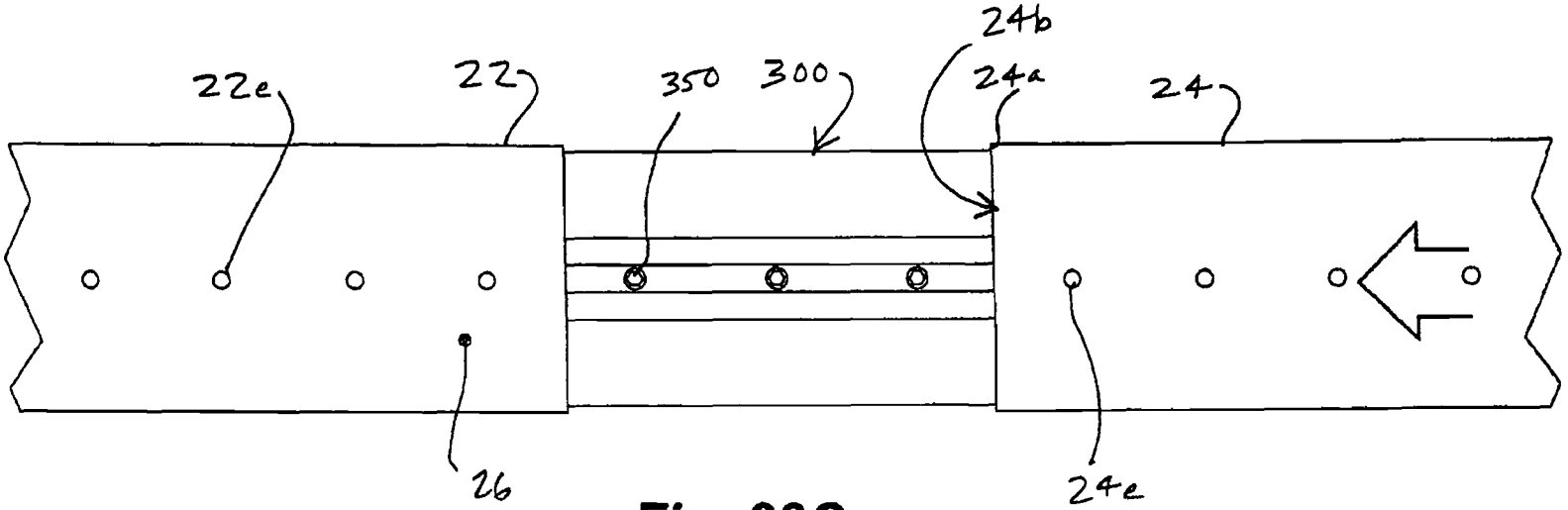
Figure 23D:
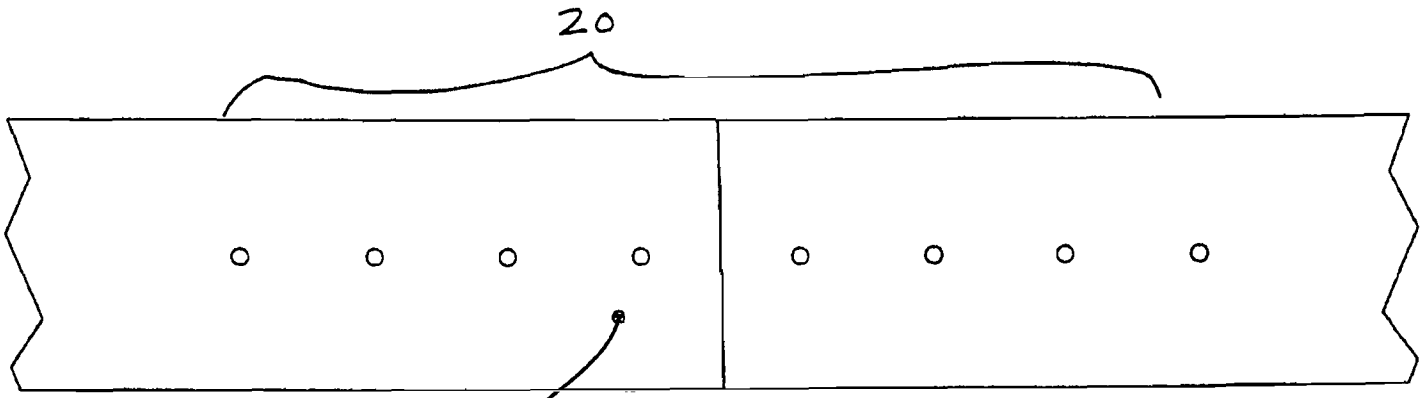

As illustrated in FIG. 23C, the temporary fixing means 26 may provide a way to keep the splicing apparatus 300 within the first collection tube section 22 while the second collection tube section 24 is slid over the splicing apparatus 300, or the splicing apparatus 300 is slid into the second collection tube section 24. A second temporary fixing means may be used in conjunction with the second collection tube section 24, as appropriate or desired.

Once the first and second collection tube sections 22 and 24 are in place over the splicing apparatus, the third movable elements 350 may be moved incrementally to gradually increase the equivalent diameter 352 of the splicing apparatus 300 within the tube sections 22, 24. Alternatively or additionally, the third movable elements may be moved sequentially and alternately, starting with one of the third movable elements farthest from the joining ends of the tube sections 22, 24, and skipping adjacent third movable elements to continue from one tube section to the other. The process may then be repeated for the skipped third movable elements.

Once each or a sufficient number of third movable elements 350 has been moved to securely engage the inner surfaces of the tube sections 22, 24, the temporary fixing means may be removed, and plug caps (not shown) may be inserted to close the respective apertures in the tube sections 22, 24.

Figure 24:
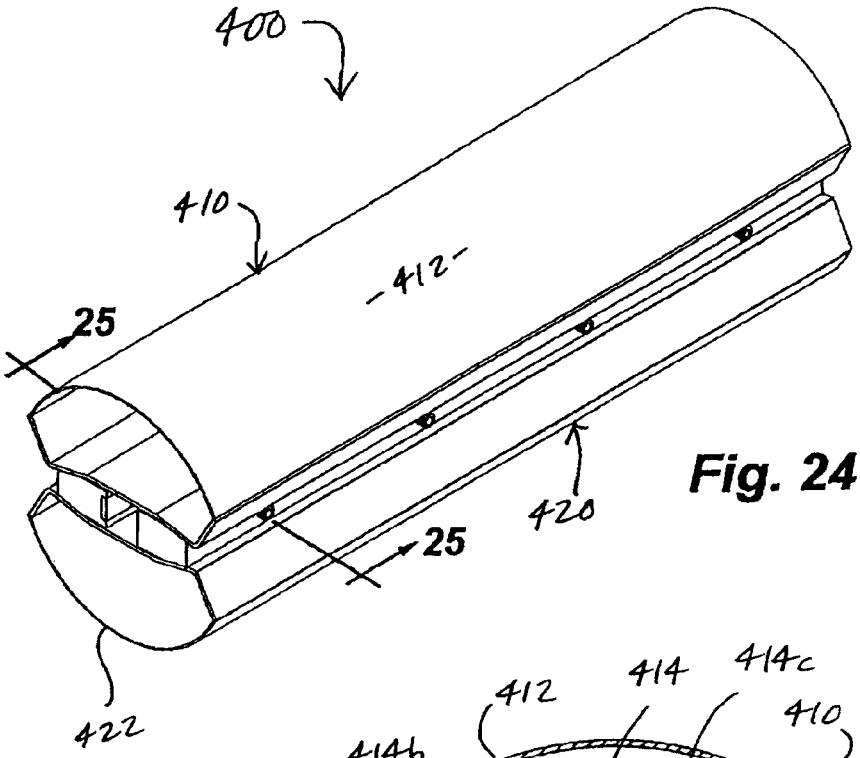
FIG. 24 is a perspective view of another embodiment of a splicing apparatus for interconnecting tubes.
Figure 25:
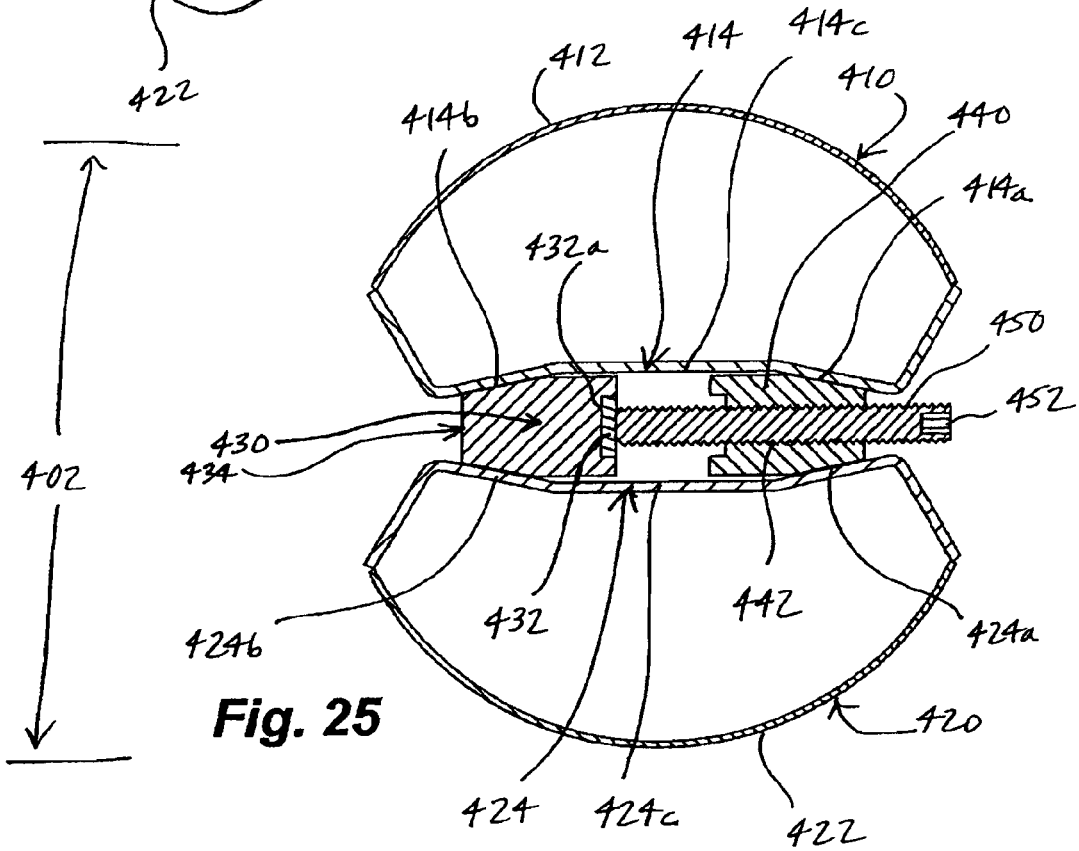
FIG. 25 is a cross-sectional illustration of the splicing apparatus as seen along line 25-25 in FIG. 24.

FIG. 24 is a perspective view of another embodiment of a splicing apparatus 400 for interconnecting tubes. FIG. 25 is a cross-sectional view as seen along line 25-25 in FIG. 24. As shown, the splicing apparatus 400 may include a first longitudinally elongate structure 410. The first elongate structure 410 may include or define a first radially outer surface 412 and a first radially inner surface 414.

The first radially inner surface 414 may include a first sloped portion 414*a*, a second sloped portion 414*b*, and an intermediate portion 414*c* therebetween. As with the embodiment discussed above with respect to FIGS. 2-7, the first and second sloped portions 414*a*, 414*b* may be described as sloping radially outward in a direction toward each other.

The splicing apparatus 400 may include a second longitudinally elongate structure or member 420. As with the first elongate structure 410, the second elongate structure may include or define a second radially outer surface 422 and a second radially inner surface 424. The second radially inner surface 424 may similarly include a first sloped portion 424*a*, a second sloped portion 424*b*, and an intermediate portion 424*c* therebetween.

The splicing apparatus 400 may include at least one first movable element 430. As discussed above, the first movable element 430 may be in the form of a wedge, which may be solid as shown, hollow or otherwise, as appropriate or desired. It should be understood that the wedge may be triangular or any other suitable shape as well, such as shown with a tapered end or portion 434 opposite an engagement surface or plate 432. In the case of the solid, wedge first movable element 430 shown, a substantially flat top may provide a suitable recess 430*a* for receiving the plate 432, which may be a material more resistant to rotational wear than the material of the first movable element 430, for example, such as steel.

The splicing apparatus 400 may include at least one second movable element 440. The second movable element 440 may also be in the form of a wedge, which may be solid as shown, hollow or otherwise, as appropriate or desired. It should be understood that the wedge may be triangular or any other suitable shape as well. In the case of the solid, wedge second movable element 440 shown, a threaded bore 442 may be formed therethrough. Alternatively, a tee nut as described above may be used.

The splicing apparatus 400 may include at least one third movable element 450. The third movable element 450 may be in the form of a threaded rod. The third movable element 450 may be configured as such to engage the threaded bore 442 with its threads and to engage the first movable element 430, for example, by contacting the bearing surface or plate 432.

As discussed above, the first and/or second movable elements 430, 440 may each be formed by a single respective elongate element or by a plurality of respective elements, as appropriate or desired. Further, although a plurality of third movable elements 450 is depicted, it should be understood that employing a single third movable element is not excluded.

Although not illustrated in FIGS. 24 and 25, it should be understood that the splicing apparatus 400 may further include means for longitudinally securing the first elongate structure 410, the second elongate structure 420, the first movable element 430 and the second movable element 440 together, as discussed above.

As will be understood from the cross-sectional view of FIG. 25, a rotation of the third movable element (threaded rod) 450 in a first direction will cause the third movable element 450 to move the first and second movable elements (wedges) 430 and 440 away from each other. Such movement of the first and second movable elements 430 and 440 will cause the first and second movable elements 430 and 440 to engage the first and second sloped portions 414*a*, 424*a* and 414*b*, 424*b*, respectively, and force the first and second elongate structures 410 and 420 to move apart. That is, such movement will cause an equivalent diameter 402 of the splicing apparatus 400 to increase or expand. Rotation of the third movable element 450 in the opposite direction may have the opposite effect, causing the equivalent diameter 402 to decrease or contract.

Although this embodiment is not illustrated as including rotational engagement structures as discussed above, it should be understood that it may include such features. Further, although the alignment and anti-rotation benefits would be reduced once the equivalent diameter of the splicing apparatus is increased or expanded as described herein, the spaces between the first sloped portions 414*a*, 424*a* of the first and second elongate structures 410, 420 and between the second sloped portions 414*b*, 424*b* of the first and second elongate structures 410, 420 may serve such a purpose for engaging suitable mating features inside the tubes to be interconnected. In other words, such spaces may provide such benefits at least when the splicing apparatus 400 is initially inserted into each tube, before increasing the equivalent diameter of the splicing apparatus 400.

Figure 26:
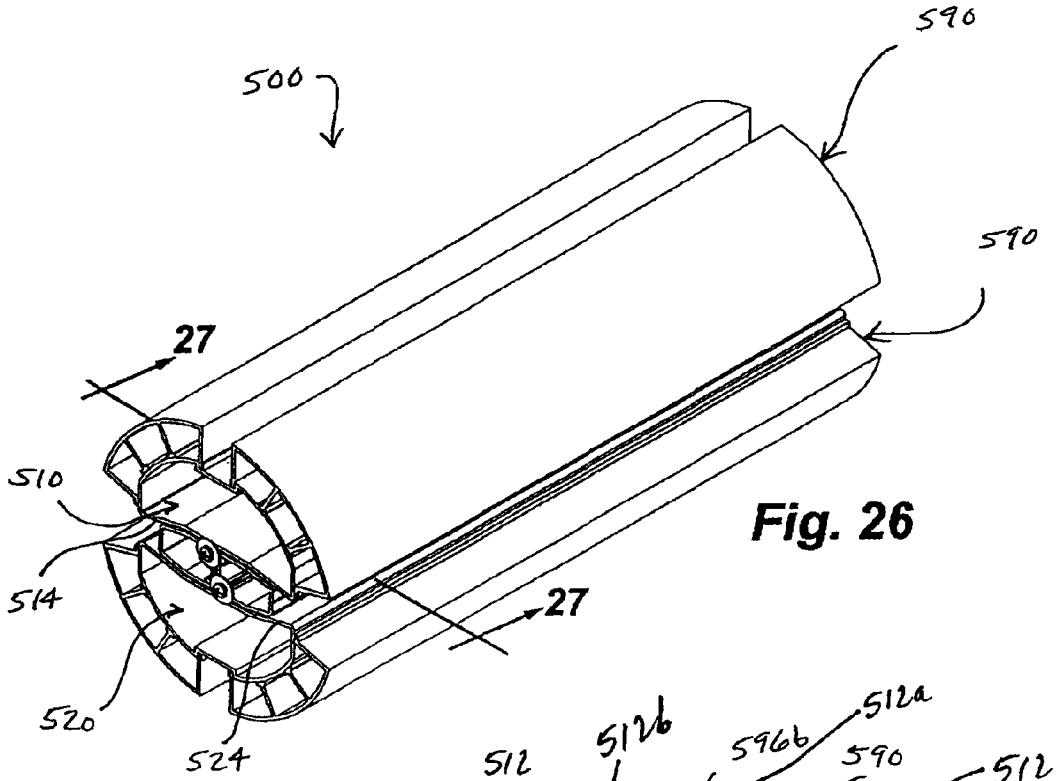
FIG. 26 is a perspective view of another embodiment of a splicing apparatus for interconnecting tubes.
Figure 27:
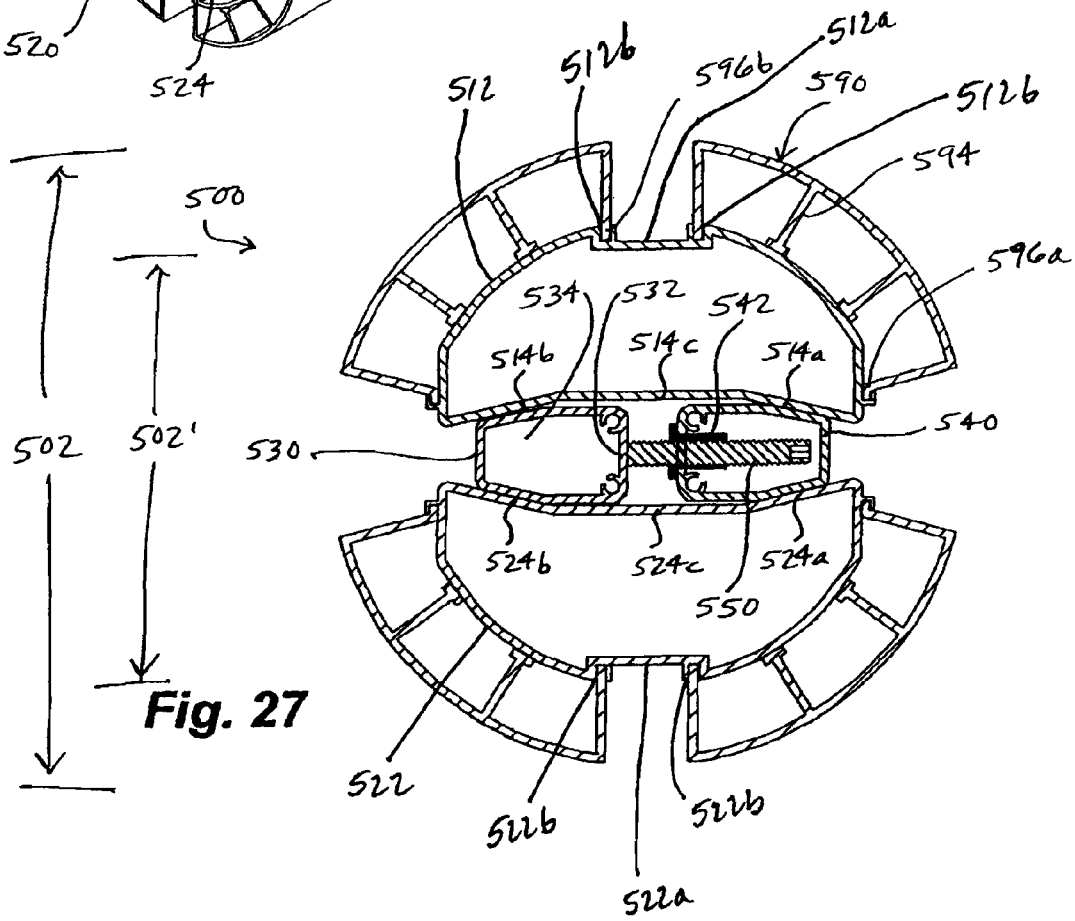
FIG. 27 is a cross-sectional illustration of the splicing apparatus as seen along line 27-27 in FIG. 26.

FIG. 26 is a perspective view of another embodiment of a splicing apparatus 500 for interconnecting tubes. FIG. 27 is a cross-sectional view as seen along line 27-27 in FIG. 26. As shown, the splicing apparatus 500 may include a first longitudinally elongate structure 510. The first elongate structure 510 may include or define a first radially outer surface 512 and a first radially inner surface 514.

The first radially inner surface 514 may include a first sloped portion 514*a*, a second sloped portion 514*b*, and an intermediate portion 514*c* therebetween. As with the embodiment discussed above with respect to FIGS. 2-7, the first and second sloped portions 514*a*, 514*b* may be described as sloping radially outward in a direction toward each other.

The splicing apparatus 500 may include a second longitudinally elongate structure or member 520. As with the first elongate structure 510, the second elongate structure may include or define a second radially outer surface 522 and a second radially inner surface 524. The second radially inner surface 524 may similarly include a first sloped portion 524*a*, a second sloped portion 524*b*, and an intermediate portion 524*c* therebetween.

The splicing apparatus 500 may include at least one first movable element 530. As discussed above, the first movable element 530 may be in the form of a wedge, which may be hollow as shown, solid or otherwise, as appropriate or desired. It should be understood that the wedge may be triangular or any other suitable shape as well, such as shown with a tapered end or portion 534 opposite an engagement surface or plate 532.

The splicing apparatus 500 may include at least one second movable element 540. The second movable element 540 may also be in the form of a wedge, which may be hollow as shown, solid or otherwise, as appropriate or desired. It should be understood that the wedge may be triangular or any other suitable shape as well. In the case of the hollow, wedge second movable element 540 shown, a threaded tee nut 542 may be secured thereto.

The splicing apparatus 500 may include at least one third movable element 550. The third movable element 550 may be in the form of a threaded rod. The third movable element 550 may be configured as such to engage the threaded tee nut 542 with its threads and to engage the first movable element 530, for example, by contacting the bearing surface or plate 532.

The splicing apparatus 500 may include a plurality of extensions 590 to be secured to the first and second elongate structures 510 and 520 to increase or expand the starting or minimum equivalent diameter 502 from the starting or minimum equivalent diameter 502' that would otherwise exist. A plurality of radial supports 594 may be employed to support each extension on the respective elongate structure 510 or 520. This may provide sufficient rigidity without unnecessary increase in weight for the splicing apparatus 500. An end of one or more of the radial supports 594 for each extension 590 may include an engagement feature, such as a flange 596*a* or an extending portion 596*b*. The radial outer surfaces of the respective first and second elongate structures 510 and 520 may include corresponding and cooperating engagement features, such as recesses 512*a* and 522*a* and tabs 512*b* and 522*b*. It should be understood, however, that any suitable manner of connecting or securing the extensions 590 to the respective first and second elongate structures may be employed.

As discussed above, the first and/or second movable elements 530, 540 may each be formed by a single respective elongate element or by a plurality of respective elements, as appropriate or desired. Further, although a plurality of third movable elements 550 is depicted, it should be understood that employing a single third movable element is not excluded.

Although not illustrated in FIGS. 26 and 27, it should be understood that the splicing apparatus 500 may further include means for longitudinally securing the first elongate structure 510, the second elongate structure 520, the first movable element 530 and the second movable element 540 together, as discussed above.

As will be understood from the cross-sectional view of FIG. 27, a rotation of the third movable element (threaded rod) 550 in a first direction will cause the third movable element 550 to move the first and second movable elements (wedges) 530 and 540 away from each other. Such movement of the first and second movable elements 530 and 540 will cause the first and second movable elements 530 and 540 to engage the first and second sloped portions 514*a*, 524*a* and 514*b*, 524*b*, respectively, and force the first and second elongate structures 510 and 520 to move apart. That is, such movement will cause an equivalent diameter 502 of the splicing apparatus 500 to increase or expand. Rotation of the third movable element 550 in the opposite direction may have the opposite effect, causing the equivalent diameter 502 to decrease or contract.

Although this embodiment is not illustrated as including rotational engagement structures as discussed above, it should be understood that it may include such features. Further, although the alignment and anti-rotation benefits would be reduced once the equivalent diameter of the splicing apparatus is increased or expanded as described herein, the spaces between the first sloped portions 514*a*, 524*a* (and/or the extensions 590) of the first and second elongate structures 510, 520 and between the second sloped portions 514*b*, 524*b* (and/or the extensions 590) of the first and second elongate structures 510, 520 may serve such a purpose for engaging suitable mating features inside the tubes to be interconnected. In other words, such spaces may provide such benefits at least when the splicing apparatus 500 is initially inserted into each tube, before increasing the equivalent diameter of the splicing apparatus 500.

Figure 28:
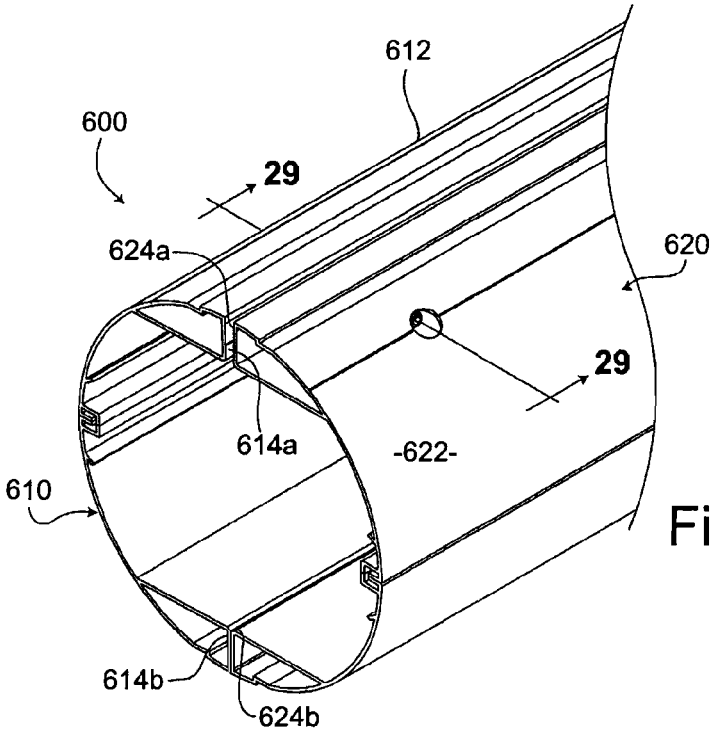
FIG. 28 is a perspective view of another embodiment of a splicing apparatus for interconnecting tubes.
Figure 29:
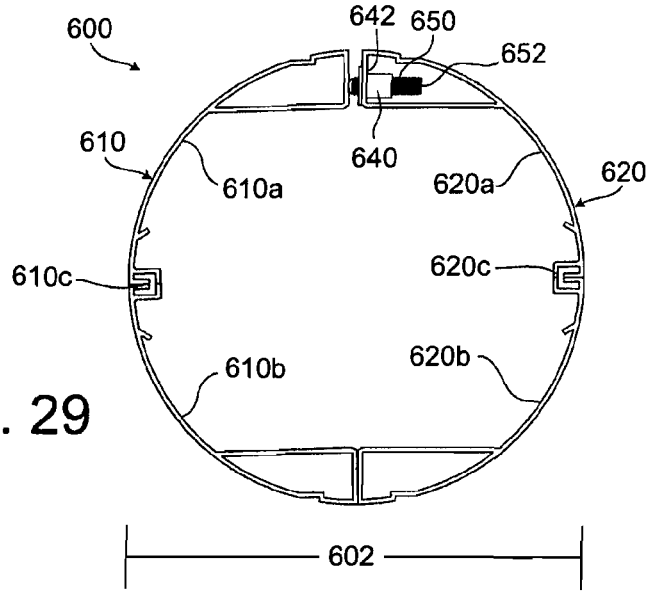
FIG. 29 is a cross-sectional illustration of the splicing apparatus as seen along line 29-29 in FIG. 28.

FIG. 28 is a perspective view of another embodiment of a splicing apparatus 600 for interconnecting tubes. FIG. 29 is a cross-sectional view as seen along line 29-29 in FIG. 28. As shown, the splicing apparatus 600 may include a first longitudinally elongate structure 610. The first elongate structure 610 may include or define a first radially outer surface 612 and a first radially inner surface 614. The first radially inner surface 614 may or may not include a sloped portion, but may include a first portion 614*a* and a second portion 614*b*.

The splicing apparatus 600 may include a second longitudinally elongate structure or member 620. As with the first elongate structure 610, the second elongate structure 620 may include or define a second radially outer surface 622 and a second radially inner surface 624. The second radially inner surface 624 may similarly include a first portion 624*a* and a second portion 624*b*.

The splicing apparatus 600 may include at least one movable element 650. In this embodiment, the movable element 650 may be the only movable element (excluding movement imparted to the first elongate structure 610 and the second elongate structure 620), and may be in the form of a threaded rod. The movable element 650 may be configured in any suitable manner that allows it to bear against the first portion 614*a*. The movable element 650 may also be configured to engage a threaded tee nut 640 disposed in a hole 642 in the first portion 624*a* of the inner surface 624.

Although a single movable element 650 is depicted, it should be understood that employing a plurality of movable elements 650 is not excluded. Also, although not illustrated in FIGS. 28 and 29, it should be understood that the splicing apparatus 600 may further include means for longitudinally securing the first elongate structure 610 and the second elongate structure 620 together, as discussed above. Further, as depicted in FIGS. 28 and 29, each of the first elongate structure 610 and the second elongate structure 620 may comprise first and second sections 610*a*, 610*b* and 620*a*, 620*b* and respective interconnectors 610*c* and 620*c* configured to connect the respective sections together as discussed above.

As will be understood from the cross-sectional view of FIG. 29, a rotation of the movable element (threaded rod) 650 in a first direction will cause the first portions 614*a* and 624*a* of the first radially inner surfaces 614 and 624 to move away from each other. Such movement will cause the first and second elongate structures 610 and 620 to move apart. That is, such movement will cause an equivalent diameter 602 of the splicing apparatus 600 to increase or expand. Rotation of the movable element 650 in the opposite direction may have the opposite effect, causing the equivalent diameter 602 to decrease or contract.

Although this embodiment is not illustrated as including rotational engagement structures as discussed above, it should be understood that it may include such features.

Figure 31:
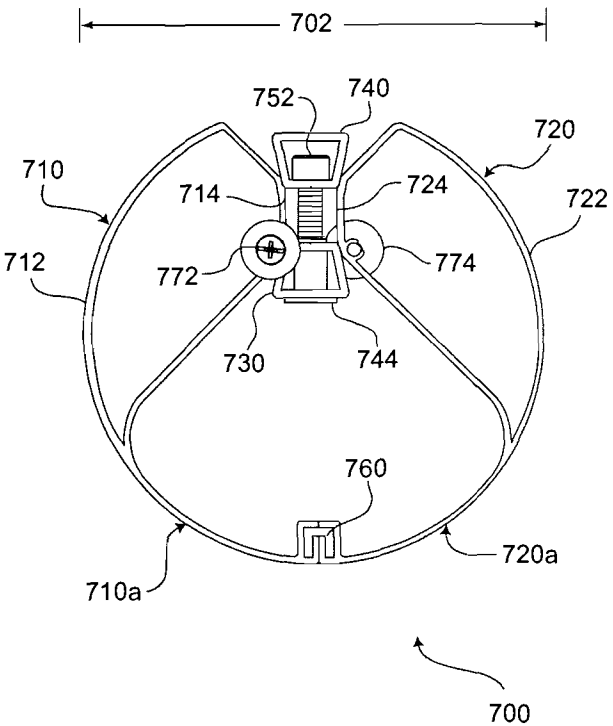
FIG. 31 is a cross-sectional illustration of the splicing apparatus shown in FIG. 30.
Figure 30:
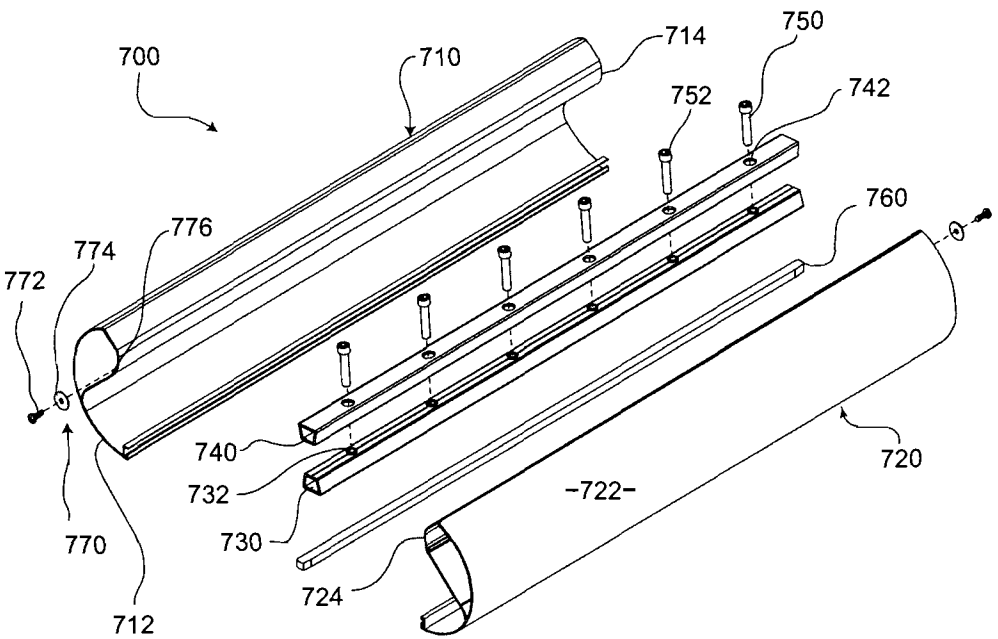
FIG. 30 is an exploded perspective view of another embodiment of a splicing apparatus for interconnecting tubes.

FIG. 30 is an exploded perspective view of another embodiment of a splicing apparatus 700 for interconnecting tubes. FIG. 31 is a cross-sectional view of the splicing apparatus 700. As shown, the splicing apparatus 700 may include a first longitudinally elongate structure 710. The first elongate structure 710 may include or define a first radially outer surface 712 and a first radially inner surface 714. The first radially inner surface 714 may or may not include chamfered or sloped edges, as shown.

The splicing apparatus 700 may include a second longitudinally elongate structure or member 720. As with the first elongate structure 710, the second elongate structure 720 may include or define a second radially outer surface 722 and a second radially inner surface 724. The second radially inner surface 724 similarly may or may not include chamfered or sloped edges as shown.

The splicing apparatus 700 may include at least one first movable element 730. The first movable element 730 may be in the form of a trapezoidal wedge, which may be hollow as shown, solid or otherwise, as appropriate or desired. It should be understood that the wedge may be triangular or any other suitable shape as well. In the case of the hollow, trapezoidal wedge first movable element 730 shown, benefits of weight reduction and strength may be obtained. Further, a substantially flat top and bottom as shown may facilitate the formation of holes 732 therethrough to receive a threaded insert 744.

The splicing apparatus 700 may include at least one second movable element 740. The second movable element 740 may also be in the form of a trapezoidal wedge, which may be hollow as shown, solid or otherwise, as appropriate or desired. It should be understood that the wedge may be triangular or any other suitable shape as well. In the case of the hollow, trapezoidal wedge second movable element 740 shown, a substantially flat top and bottom as shown may facilitate the formation of holes 742.

The splicing apparatus 700 may include at least one third movable element 750. The third movable element 750 may be in the form of a threaded bolt including a head 752. The third movable element 750 may be configured as such to engage the threaded insert 744 of the first movable element 730, while the head 752 of the third movable element 750 engages the second movable element 740, as shown in FIG. 31.

The first elongate structure 710 and the second elongate structure 720 may be formed as extrusions of aluminum or other suitable material. The first movable element 730 and the second movable element 740 may be made of extruded aluminum, acetal or other suitable material that provides a high bending moment of inertia.

It should be understood from FIG. 30 that the first and/or second movable elements 730, 740 may be formed by a single respective elongate element or by a plurality of respective elements, as appropriate or desired. Further, although a plurality of third movable elements 750 is depicted, it should be understood that employing a single third movable element is not excluded.

The splicing apparatus 700 may further include means 770 for longitudinally securing the first elongate structure 710, the second elongate structure 720, the first movable element 730 and the second movable element 740 together. As discussed above, the means 770 may comprise a washer 774, an associated screw 772 and a corresponding bore 776 formed on at least one of the first elongate structure 710, the second elongate structure 720, the first movable element 730 and the second movable element 740. By providing means 770 at each end of the splicing apparatus 700, the splicing apparatus 700 may be held together to move longitudinally as a unit.

The first elongate structure 710 and the second elongate structure 720 may be connected together, for example, opposite the interconnection formed by the means 770 and the movable elements 730, 740. Similar to the embodiment discussed above with respect to FIGS. 15-19B, an interconnector 760 may secure the first elongate structure 710 and the second elongate structure 720 together.

Once secured together, it should be understood that the first elongate structure 710 and/or the second elongate structure 720 may be configured to allow the surfaces 714 and 724 to be moved apart. For example, a section 710*a* of the first elongate structure 710 and a section 720*a* of the second elongate structure 720 may be configured to flex as the surfaces 714 and 724 are moved apart. As discussed above, for example, as the third movable element 750 is rotated to move the first and second movable elements 730 and 740 toward each other, the first and second movable elements 730 and 740 may push radially outward on the chamfered edges of the surfaces 714 and 724. The resulting expansion of the splicing apparatus 700 increases the equivalent diameter as the sections 710*a*, 720*a* flex outwardly.

As will be understood from the cross-sectional view of FIG. 31, a rotation of the third movable element (threaded rod) 750 in a first direction will cause the first radially inner surfaces 714 and 724 to move away from each other. Such movement will cause the first and second elongate structures 710 and 720 to move apart (except for at the interconnector 760). That is, such movement will cause an equivalent diameter 702 of the splicing apparatus 700 to increase or expand. Rotation of the third movable element 750 in the opposite direction may have the opposite effect, causing the equivalent diameter 702 to decrease or contract.

Although this embodiment is not illustrated as including rotational engagement structures as discussed above, it should be understood that it may include such features.

Figure 33:
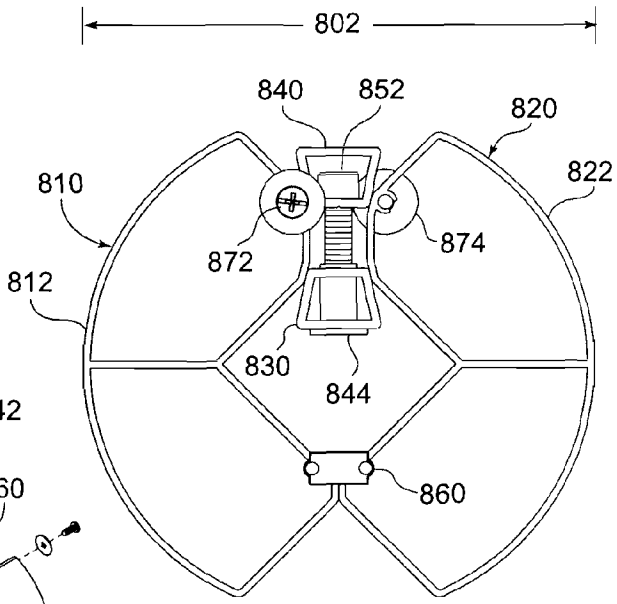
FIG. 33 is a cross-sectional illustration of the splicing apparatus shown in FIG. 32.
Figure 32:
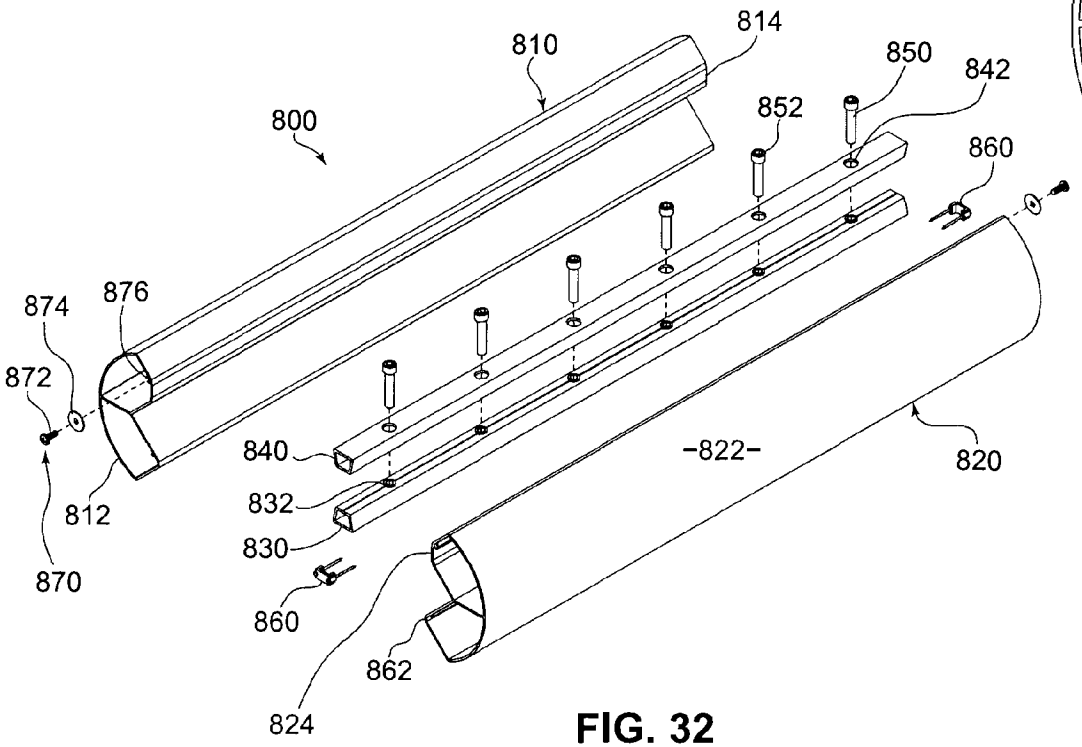
FIG. 32 is an exploded perspective view of another embodiment of a splicing apparatus for interconnecting tubes.

FIG. 32 is an exploded perspective view of another embodiment of a splicing apparatus 800 for interconnecting tubes. FIG. 33 is a cross-sectional view of the splicing apparatus 800. As shown, the splicing apparatus 800 may include a first longitudinally elongate structure 810. The first elongate structure 810 may include or define a first radially outer surface 812 and a first radially inner surface 814. The first radially inner surface 814 may or may not include chamfered or sloped edges, as shown.

The splicing apparatus 800 may include a second longitudinally elongate structure or member 820. As with the first elongate structure 810, the second elongate structure 820 may include or define a second radially outer surface 822 and a second radially inner surface 824. The second radially inner surface 824 similarly may or may not include chamfered or sloped edges as shown.

The splicing apparatus 800 may include at least one first movable element 830. The first movable element 830 may be in the form of a trapezoidal wedge, which may be hollow as shown, solid or otherwise, as appropriate or desired. It should be understood that the wedge may be triangular or any other suitable shape as well. In the case of the hollow, trapezoidal wedge first movable element 830 shown, benefits of weight reduction and strength may be obtained. Further, a substantially flat top and bottom as shown may facilitate the formation of holes 832 therethrough to receive a threaded insert 844.

The splicing apparatus 800 may include at least one second movable element 840. The second movable element 840 may also be in the form of a trapezoidal wedge, which may be hollow as shown, solid or otherwise, as appropriate or desired. It should be understood that the wedge may be triangular or any other suitable shape as well. In the case of the hollow, trapezoidal wedge second movable element 840 shown, a substantially flat top and bottom as shown may facilitate the formation of holes 842.

The splicing apparatus 800 may include at least one third movable element 850. The third movable element 850 may be in the form of a threaded bolt including a head 852. The third movable element 850 may be configured as such to engage the threaded insert 844 of the first movable element 830, while the head 852 of the third movable element 850 engages the second movable element 840, as shown in FIG. 33.

The first elongate structure 810 and the second elongate structure 820 may be formed as extrusions of aluminum or other suitable material. The first movable element 830 and the second movable element 840 may be made of extruded aluminum, acetal or other suitable material that provides a high bending moment of inertia.

It should be understood from FIG. 32 that the first and/or second movable elements 830, 840 may be formed by a single respective elongate element or by a plurality of respective elements, as appropriate or desired. Further, although a plurality of third movable elements 850 is depicted, it should be understood that employing a single third movable element is not excluded.

The splicing apparatus 800 may further include means 870 for longitudinally securing the first elongate structure 810, the second elongate structure 820, the first movable element 830 and the second movable element 840 together. As discussed above, the means 870 may comprise a washer 874, an associated screw 872 and a corresponding bore 876 formed on at least one of the first elongate structure 810, the second elongate structure 820, the first movable element 830 and the second movable element 840. By providing means 870 at each end of the splicing apparatus 800, the splicing apparatus 800 may be held together to move longitudinally as a unit.

The first elongate structure 810 and the second elongate structure 820 may be connected together, for example, opposite the interconnection formed by the means 870 and the movable elements 830, 840. Similar to the embodiments discussed above with respect to FIGS. 15-19B, an interconnector 860, such as a cable staple, may secure the first elongate structure 810 and the second elongate structure 820 together at each end, for example, by driving the tacks of the cable staples into respective bores 862 formed in the elongate structures 810, 820.

Once secured together, it should be understood that the first elongate structure 810 and/or the second elongate structure 820 may be configured to allow the surfaces 814 and 824 to be moved apart. This may be accomplished via flexing of the structures 810, 820 and/or the interconnector 860 acting as a hinge.

As will be understood from the cross-sectional view of FIG. 33, a rotation of the third movable element (threaded rod) 850 in a first direction will cause the first radially inner surfaces 814 and 824 to move away from each other. Such movement will cause the first and second elongate structures 810 and 820 to move apart (except for near the interconnector 860). That is, such movement will cause an equivalent diameter 802 of the splicing apparatus 800 to increase or expand. Rotation of the third movable element 850 in the opposite direction may have the opposite effect, causing the equivalent diameter 802 to decrease or contract.

Although this embodiment is not illustrated as including rotational engagement structures as discussed above, it should be understood that it may include such features.

Although various details and representative embodiments are described above, it should be understood that numerous alterations to the disclosed embodiments without departing from the spirit or scope of the inventive subject matter set forth in this specification, including the claims. In particular, it should be understood that any of the features illustrated and/or discussed with respect to any one embodiment may be employed in combination with any other features of other embodiments, as may be appropriate or desired.

We claim:

1. An apparatus for interconnecting tubes, the apparatus comprising:

a. a first longitudinally elongate structure including a first outer surface and a first inner surface;

b. a second longitudinally elongate structure including a second outer surface and a second inner surface, the first and second structures being configured to be arranged with the first and second inner surfaces facing each other and the first and second outer surfaces defining an equivalent diameter; and c. at least one moveable element configured to engage the first and second inner surfaces, whereby movement of the at least one movable element changes a relative position of the first and second structures thereby changing the equivalent diameter defined by the first and second outer surfaces.

2. The apparatus of claim 1 in which, when the at least one moveable element engages the first and second inner surfaces, the first and second outer surfaces collectively define a non-circular, generally oblong cross-section.

3. The apparatus of claim 1 in which the at least one moveable element includes an engagement feature configured to receive, or be received by, a tool.

4. The apparatus of claim 1 in which the at least one moveable element comprises a first moveable element in the form of a trapezoidal wedge.

5. The apparatus of claim 4 further comprising a second moveable element.

6. The apparatus of claim 5 in which the second moveable element is in the form of a trapezoidal wedge.

7. The apparatus of claim 6 further comprising a third moveable element in the form of a threaded rod configured to engage the first moveable element.

8. The apparatus of claim 7 in which the threaded rod is configured to rotate, with rotation in the first direction causing movement of the first and second moveable elements away from each other.

9. A kit for a pool cover assembly, the kit comprising:

a. a first tube including a hollow end;

b. a second tube including a hollow end; and c. an apparatus configured to be positioned in the hollow end of the first tube and in the hollow end of the second tube and expanded radially, so as to increase its equivalent diameter, while positioned herein to interconnect the first tube and the second tube.

10. The kit of claim 9 in which (a) the apparatus comprises at least one moveable element including an engagement feature configured to receive, or be received by, a tool and (b) at least one of the first tube and the second tube has an aperture into which the tool may be inserted to access the engagement feature.

11. A method of interconnecting a first tube and a second tube using a splicing apparatus, the method comprising:

a. positioning the splicing apparatus in an end of the first tube;

b. positioning the splicing apparatus in an end of the second tube; and c. increasing an equivalent diameter of the splicing apparatus while positioned in the end of the first tube and in the end of the second tube to engage an inner surface of each of the first and second tubes, thereby interconnecting the first tube and the second tube with the splicing apparatus.

12. The method of claim 11, wherein increasing the equivalent diameter of the splicing apparatus comprises moving a moveable element of the splicing apparatus.

13. The method of claim 12, wherein moving the moveable element of the splicing apparatus comprises rotating the moveable element.

14. A pool cover assembly comprising:

a. a pool cover;

b. a tube assembly connected to the pool cover, the tube assembly comprising:

i. a first tube having a hollow end and an aperture;

ii. a second tube having a hollow end; and iii. an apparatus configured to be positioned in the hollow end of the first tube and in the hollow end of the second tube and expanded while positioned therein to interconnect the first tube and the second tube, the apparatus comprising:

A. a first moveable element in the form of a trapezoidal wedge;

B. a second moveable element in the form of a trapezoidal wedge; and

C. a third moveable element in the form of a threaded rod configured to engage the first moveable element and including an engagement feature configured to receive, or be received by, a tool inserted through the aperture.

* * * * *